US007596335B2

(12) United States Patent
Fukami et al.

(10) Patent No.: US 7,596,335 B2
(45) Date of Patent: Sep. 29, 2009

(54) FIELD ASSISTED CLEANING SYSTEM FOR A TRANSFER BELT AND AN IMAGE FORMING APPARATUS

(75) Inventors: Tsunemitsu Fukami, Nagoya (JP); Kazushi Fukuta, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 144 days.

(21) Appl. No.: 11/497,273

(22) Filed: Aug. 2, 2006

(65) Prior Publication Data

US 2007/0036578 A1 Feb. 15, 2007

(30) Foreign Application Priority Data

Aug. 4, 2005 (JP) ..... 2005-226300

(51) Int. Cl.
*G03G 15/16* (2006.01)

(52) U.S. Cl. ..... 399/71; 399/43; 399/101; 399/99

(58) Field of Classification Search ..... 399/101, 399/43, 71, 55, 88, 354
See application file for complete search history.

(56) References Cited

U.S. PATENT DOCUMENTS 5,579,096 A * 11/1996 Saito et al. ..... 399/101
5,600,405 A * 2/1997 Umeda et al. ..... 399/71
5,740,494 A * 4/1998 Shoji et al. ..... 399/71
5,923,936 A * 7/1999 Tanoue et al. ..... 399/297
6,014,158 A * 1/2000 Ziegelmuller et al. ..... 347/142
6,480,695 B2 11/2002 Endo et al.
6,829,450 B2 * 12/2004 Tamiya et al. ..... 399/66
2001/0028802 A1 * 10/2001 Otomo et al. ..... 399/27
2004/0071483 A1 * 4/2004 Murakami et al. ..... 399/311
2004/0265007 A1 * 12/2004 Hara ..... 399/176
2005/0074250 A1 4/2005 Nishiwaki et al.

FOREIGN PATENT DOCUMENTS

JP 01214889 A * 8/1989
JP 05289593 A * 11/1993
JP 2002-031997 1/2002

* cited by examiner

*Primary Examiner*—David M Gray
*Assistant Examiner*—G. M. Hyder
(74) *Attorney, Agent, or Firm*—Banner & Witcoff, Ltd.

(57) ABSTRACT

An image forming device is provided with a photoreceptor, a belt, a back member, a front member, and a voltage change device. The belt faces the photoreceptor. The back member is disposed on a back side of the belt. The front member is disposed on a front side of the belt. The front member is disposed adjacent to the belt and faces the back member. The voltage change device is configured to change voltage between the back member and the front member within a range excluding zero. Based on detected conditions such as the number of sheets printed, the replacement of a developer cartridge, or the current between the back member and the front member, the voltage change device change the voltage between the back member and the front member to enhance the ability to clean the belt.

26 Claims, 11 Drawing Sheets

| Sheets | 0 | 10000 | 20000 | 30000 | 40000 |
|---|---|---|---|---|---|
| Potential1 | -1000 | -1050 | -1100 | -1150 | -1200 |
| Potential2 | -1600 | -1700 | -1800 | -1900 | -2000 |

FIELD ASSISTED CLEANING SYSTEM FOR A TRANSFER BELT AND AN IMAGE FORMING APPARATUS

CROSS-REFERENCE TO RELATED APPLICATION

This application claims priority to Japanese Patent Application NO. 2005-226300, filed on Aug. 4, 2005, the contents of which are hereby incorporated by reference into the present application.

BACKGROUND OF THE INVENTION

1. Field of the Invention

The present invention relates to an image forming device comprising a photoreceptor such as a laser printer etc.

2. Description of the Related Art

A laser printer forms an image on a printing sheet by transferring a developer developed on a photoreceptor onto the printing sheet. Some laser printers comprise a belt disposed so as to face the photoreceptor. This belt may be used to convey the printing sheet while causing the printing sheet to contact the photoreceptor. As the printing sheet is conveyed while contacting the photoreceptor, the developer is transferred onto the printing sheet from the photoreceptor. In the present specification, a belt for conveying a print medium (printing sheet or the like) will be referred to as a conveyor belt.

Furthermore, a belt is known which contacts the photoreceptor such that the developer is transferred onto the belt from the photoreceptor. The printing sheet contacts a part of the belt on which the developer has been transferred. The developer is thus transferred onto the printing sheet from the belt. In this technique, a primary transfer from the photoreceptor to the belt and a secondary transfer from the belt to the printing sheet are performed. In the present specification, a belt used in an image forming device which adopts this technique of performing the primary transfer and the secondary transfer will be referred to as an intermediate transfer belt.

Paper particles of the printing sheet adhere to the conveyor belt. If the paper particles remain on the conveyor belt, the printing quality may deteriorate. Further, an image forming device is known which evaluates the concentration of the developer by transferring the developer from the photoreceptor to the conveyor belt on a trial basis. Further, developer may adhere to the conveyor belt during a paper jam. If the developer remains on the conveyor belt, the printing sheet is stained when the conveyor belt conveys the printing sheet. Therefore, the conveyor belt must be cleaned to remove the paper particles and developer.

There is a possibility that the developer transferred onto the intermediate transfer belt during the primary transfer is not transferred entirely onto the printing sheet during the secondary transfer. If developer remains on the intermediate transfer belt, this developer may be transferred onto the printing sheet. In this case, the developer is transferred onto unintended parts of the printing sheet, and this causes deterioration of the printing quality. Therefore, the intermediate transfer belt must be cleaned to remove the developer not having been transferred to the printing sheet in the secondary transfer.

As described above, when the conveyor belt or the intermediate transfer belt is used, the belt must be cleaned. US Patent Application Publication NO. 2005/0074250 discloses a technique for cleaning the belt. This technique adopts a back roller disposed on the back side of the belt and a front roller disposed on the front side of the belt. The front roller faces the back roller. In this technique, a constant voltage is applied between the back roller and front roller. The paper particles and developer adhered to the belt move to the front roller by an electric field generated between the back roller and front roller. The paper particles and developer are thus trapped on the front roller, and the belt is cleaned.

BRIEF SUMMARY OF THE INVENTION

A front member (the front roller in the prior art described above) disposed on a front side of a belt traps paper particles and/or developer from the belt. If the paper particles and/or developer remain on the front member, the ability of the front member to clean the belt deteriorates. In the prior art described above, the front member is cleaned by another member. However, the paper particles and/or developer trapped on the front member cannot be removed completely by cleaning the front member, and paper particles and/or developer accumulate on the front member. Even when the front member is cleaned, its ability to clean the belt deteriorates steadily as the image forming device is used.

The present invention has been created in consideration of the circumstances described above, and it is a purpose thereof to provide a technique which enables an improvement in belt cleaning ability.

As a result of research, the present inventors learned that the belt cleaning ability of the front member is greatly affected by the magnitude of current flowing between a back member (the back roller in the prior art described above) and the front member. More specifically, it was discovered that even when a constant voltage is applied between the back member and front member such that an electric field having a fixed magnitude is generated, the belt cleaning ability of the front member changes when the current that flows between the back member and front member changes. Cleaning can be performed efficiently if maintaining the current between the back member and front member within a certain range. However, the cleaning ability deteriorates if the current deviates from this range.

When the front member becomes soiled, the electric resistance of the front member changes (usually increases). Therefore, in a case where the voltage between the front member and back member is regulated to a constant magnitude, the magnitude of the current between the front member and back member changes when the front member becomes soiled. When the magnitude of the current changes, the belt cleaning ability of the front member deteriorates such that the front member becomes unable to trap the paper particles and/or developer adhered to the belt satisfactorily.

An image forming device of the present invention has been created on the basis of the knowledge described above.

The image forming device of the present invention comprises a photoreceptor and a belt facing the photoreceptor. The photoreceptor may be a photoreceptor drum. The photoreceptor also may be a photoreceptor belt. The belt may be a conveyor belt or an intermediate transfer belt. The image forming device comprises a back member disposed on a back side of the belt and a first front member disposed on a front side of the belt. The first front member is disposed adjacent to the belt and facing the back member. The image forming device also comprises a first voltage change device which is capable of changing voltage between the back member and the first front member from a certain value other than zero to another value other than zero. In other words, the first voltage change device is capable of changing the voltage in a range excluding zero.

The above term "in a range excluding zero" is used to the exclusion of a structure in which the voltage is merely switched ON and OFF between zero and a predetermined value other than zero.

The first voltage change device may change the voltage among certain value other than zero, another value other than zero, and zero. The first voltage change device may change the voltage among more than three values. For example, the first voltage change device may change the voltage among a first value other than zero, a second value other than zero, and a third value other than zero.

In this image forming device, when the first front member becomes soiled, the magnitude of the voltage between the back member and first front member may be changed. By changing the magnitude of the voltage, the current flowing between the back member and first front member can be adjusted to a current which allows paper particles and/or developer adhered to the belt to be trapped by the first front member efficiently. This image forming device is able to maintain a favorable belt cleaning ability even when the first front member becomes soiled.

DETAILED DESCRIPTION OF THE INVENTION

First Embodiment

Figure 1:
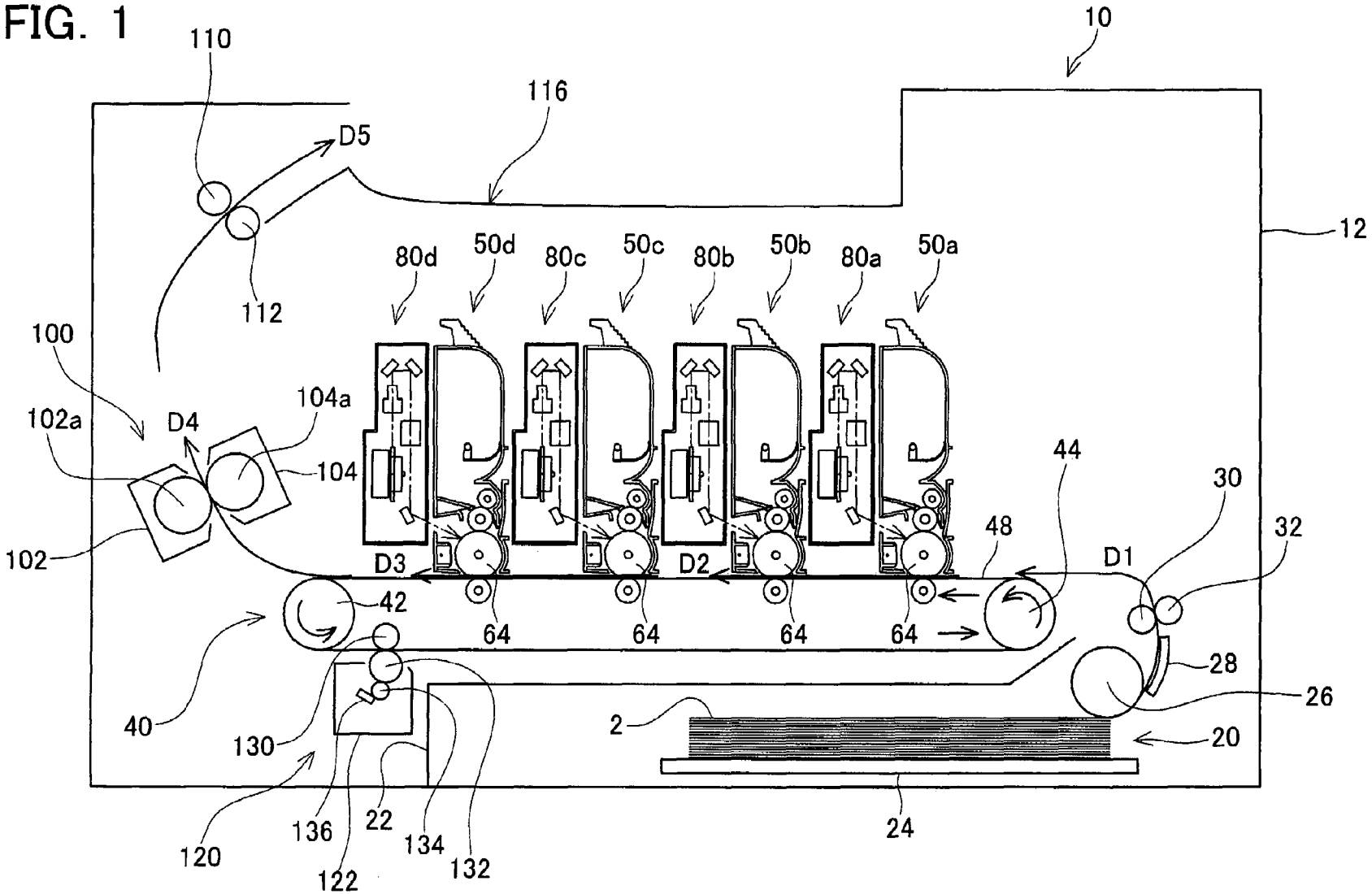
FIG. 1 shows a schematic side view of a laser printer of a first embodiment.

An embodiment of the present invention will be described with reference to the drawings. FIG. 1 is a view showing a simplification of the structure of a laser printer 10 according to this embodiment.

The laser printer 10 comprises an overall casing 12. A paper feeding device 20, a printing sheet conveying device 40, development devices 50*a* to 50*d*, exposure devices 80*a* to 80*d*, a toner fixing device 100, a belt cleaning device 120, and so on are provided in the interior of the overall casing 12. These devices 20, 40, etc. will be described in sequence.

The paper feeding device 20 comprises a paper feeding tray 22, three rollers 26, 30, 32, a guide 28, and so on. The paper feeding tray 22 can be pulled out from the overall casing 12. When pulled out from the overall casing 12, printing sheets 2 can be replenished in the paper feeding tray 22. The paper feeding tray 22 comprises a base plate 24 on which a stack of the printing sheets 2 is placed. The uppermost sheet of the printing sheets 2 placed on the base plate 24 contacts the roller 26. When the paper feeding tray 22 is stored inside the overall casing 12, a right end portion of the base plate 24 is biased upward by a mechanism not shown in the drawing. Hence, when the number of the printing sheets 2 becomes low, the right end portion of the base plate 24 is raised upward. By means of this structure, the uppermost sheet of the printing sheets 2 can be kept in constant contact with the roller 26.

The roller 26 will be referred to as a paper feeding roller. The rollers 30, 32 will be referred to as conveyance rollers. The paper feeding roller 26 is connected to a drive source not shown in the drawing. When feeding the printing sheet 2, the paper feeding roller 26 rotates counterclockwise. As a result, the uppermost sheet of the printing sheets 2 is conveyed toward the guide 28 and conveyance rollers 30, 32 (arrow D1). The guide 28 guides the printing sheet 2 conveyed by the paper feeding roller 26 toward between the conveyance rollers 30, 32. The conveyance roller 32 is not connected to a drive source. The conveyance roller 30 is connected to a drive source, not shown in the drawing, and is rotated counterclockwise thereby. When the conveyance roller 30 rotates counterclockwise, the conveyance roller 32 rotates clockwise in response thereto. Thus the printing sheet 2 is conveyed between the conveyance rollers 30, 32 in the direction of the arrow D1.

The printing sheet conveying device 40 is disposed above the paper feeding tray 22. The printing sheet conveying device 40 comprises two belt rollers 42, 44, a belt 48, a frame not shown in the drawing, and so on. The belt roller 42 and the belt roller 44 have a columnar shape extending in a perpendicular direction to the paper surface of FIG. 1. The belt roller 42 and the belt roller 44 are disposed in parallel and at an identical height. The belt 48 straddles the belt roller 42 and the belt roller 44. The belt roller 42 is connected to a drive source not shown in the drawing, and is rotated counterclockwise thereby. The belt roller 44 is a driven roller. When the belt roller 42 rotates counterclockwise, the belt 48 rotates counterclockwise, and in response to the rotation of the belt 48, the belt roller 44 rotates counterclockwise.

The printing sheet 2 conveyed by the conveyance rollers 30, 32 is placed on the upper surface of the belt 48 at the upper side thereof. The printing sheet 2 placed on the belt 48 is conveyed in a leftward direction as the belt 48 rotates (in the direction of arrows D2 and D3). Toner is transferred onto the printing sheet 2 in sequence from the four development devices 50*a* to 50*d*.

The four development devices 50*a* to 50*d* are aligned in the horizontal direction. The development device 50*a* disposed furthest to the right transfers yellow toner onto the printing sheet 2. The development device 50*b* disposed directly to the left of the development device 50*a* transfers magenta toner onto the printing sheet 2. The development device 50*c* disposed directly to the left of the development device 50*b* transfers cyan toner onto the printing sheet 2. The development device 50*d* disposed furthest to the left transfers black toner onto the printing sheet 2.

Figure 2:
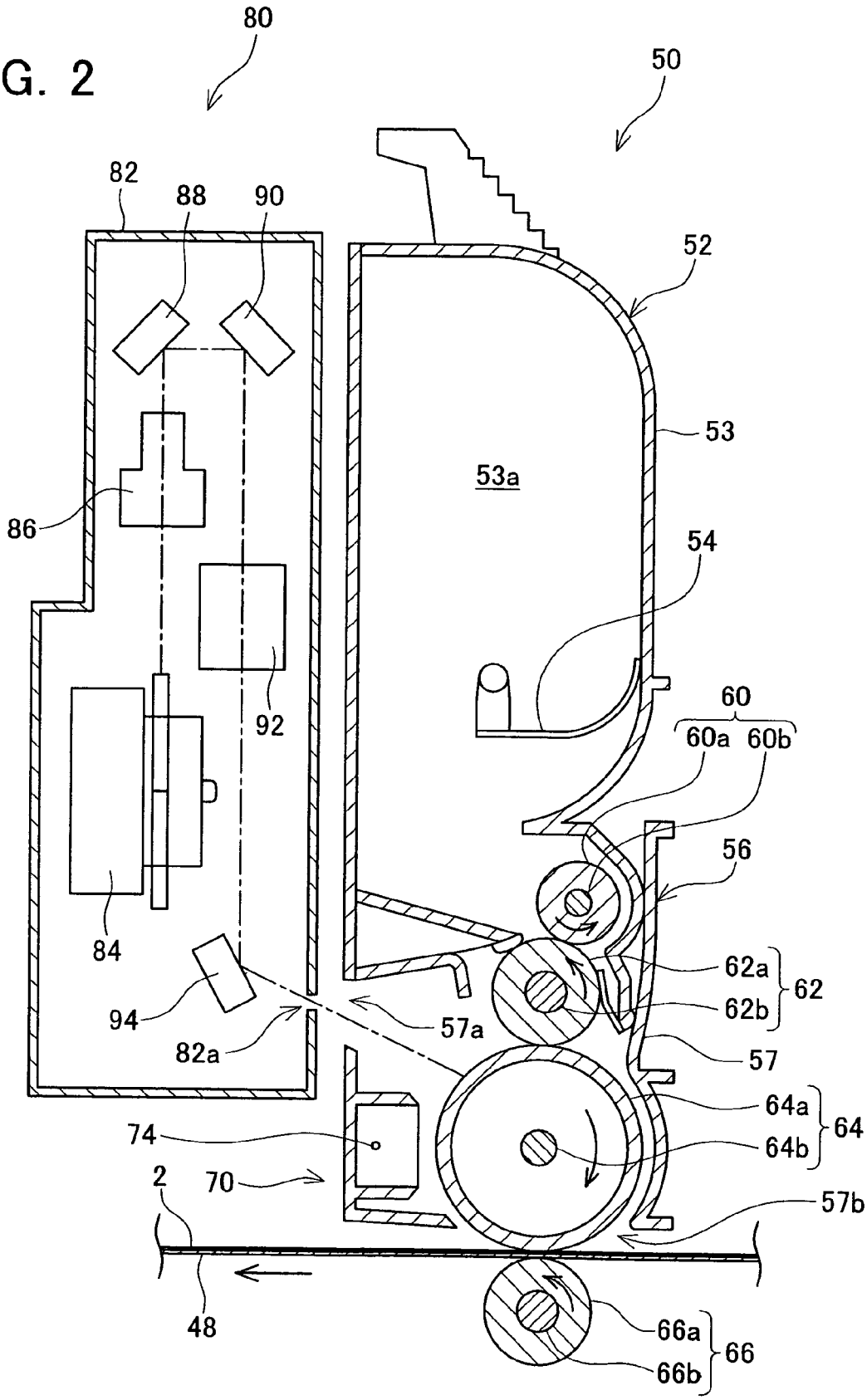
FIG. 2 shows a sectional view of a development device and an exposure device.

The four development devices 50*a* to 50*d* are structured identically. Referring to FIG. 2, the structure of the development devices 50*a* to 50*d* will be described. FIG. 2 is a vertical sectional view of the development device 50 and the exposure device 80. Note that in FIG. 2, the reference numeral 50 is used to represent the development devices 50*a* to 50*d*. The reference numeral 50 will be used similarly hereafter when there is no particular need to differentiate between the individual development devices 50*a* to 50*d*. Also in FIG. 2, the reference numeral 80 is used to represent the exposure devices 80*a* to 80*d*. The reference numeral 80 will be used similarly hereafter when there is no particular need to differentiate between the individual exposure devices 80*a* to 80*d*.

The development device 50 comprises two cartridges 52, 56, a transfer roller 66, and so on. The upper side cartridge 52 will be referred to as a development cartridge. The lower side cartridge 56 will be referred to as a photoreceptor cartridge 56. The development cartridge 52 and the photoreceptor cartridge 56 will be referred to together as a process cartridge. The process cartridge is mounted in the overall casing 12 detachably. An old process cartridge may be removed from the overall casing 12 and exchanged for a new one. The development cartridge 52 and photoreceptor cartridge 56 are connected to each other in a manner allowing the cartridges 52 and 56 to be separated. With this process cartridge, it is possible to exchange the development cartridge 52 alone and to exchange the photoreceptor cartridge 56 alone. The process cartridge may also be replaced as a whole.

The structure of the development cartridge 52 will now be described. The development cartridge 52 comprises a casing 53. A toner chamber 53*a* is formed in the interior of the casing 53. Toner is stored in the toner chamber 53*a*. The respective development devices 50*a* to 50*d* each store a different colored toner. Yellow toner is stored in the toner chamber 53*a* of the development device 50*a*. Magenta toner is stored in the toner chamber 53*a* of the development device 50*b*. Cyan toner is stored in the toner chamber 53*a* of the development device 50*c*. Black toner is stored in the toner chamber 53*a* of the development device 50*d*.

In this embodiment, a positively-charged, non-magnetic single-component toner is used. A polymer toner is used which is obtained, for example, by subjecting a styrene monomer or an acrylic monomer to copolymerization using a polymerization method such as suspension polymerization. Acrylic acid, alkyl (C1 to C4) acrylate, alkyl (C1 to C4) methacrylate, and so on may be adopted as the acrylic monomer. This polymer toner has a substantially spherical shape and exhibits excellent fluidity. A colorant is blended with the polymer toner. As a result, toners of the four colors (yellow, magenta, cyan, black) are realized. A charge controlling agent is blended with the polymer toner. A resin obtained from a copolymer of an ionic monomer and another monomer (a styrene monomer or acrylic monomer) may be adopted as the charge controlling agent. A monomer having an ionic functional moiety such as ammonium salt may be adopted as an ionic monomer. Further, an external additive is added to the polymer toner. A metallic oxide powder, carbide powder, metallic salt powder, or another powder may be adopted as the external additive. Silica, aluminum oxide, strontium titanate, cerium oxide, magnesium oxide, or similar may be adopted as the metallic oxide.

An agitator 54 is housed in the toner chamber 53*a*. The agitator 54 is attached to the casing 53 in a manner allowing its rotation. When the agitator 54 rotates, the toner in the toner chamber 53*a* is agitated.

A supply roller 60 and a developing roller 62 are housed in the casing 53. The supply roller 60 is supported by the casing 53 in a manner allowing its rotation. The supply roller 60 comprises a supply roller main body 60*a* and a supply roller shaft 60*b*. The supply roller main body 60*a* is formed from a conductive foamed material. The supply roller shaft 60*b* is made of metal. The supply roller shaft 60*b* is connected to a drive source not shown in the drawing, and thus the supply roller 60 rotates counterclockwise.

The developing roller 62 contacts the lower side of the supply roller 60. The developing roller 62 is supported by the casing 53 in a manner allowing its rotation. The developing roller 62 comprises a developing roller main body 62*a* and a developing roller shaft 62*b*. The developing roller main body 62*a* is made of a conductive rubber material. Conductive urethane rubber or silicone rubber containing carbon microparticles or the like may be adopted as the rubber material. The surface of the urethane rubber or silicone rubber is covered by urethane rubber or silicone rubber containing fluorine. The developing roller shaft 62*b* is made of metal. A voltage supply circuit, not shown in the drawing, is connected to the developing roller shaft 62*b*. During development (when the toner is adhered to a photoreceptor drum 64 (to be described below)), a bias is applied to the developing roller 62 from the voltage supply circuit. The developing roller 62 is connected to a drive source not shown in the drawing, and is rotated counterclockwise thereby.

Next, the structure of the photoreceptor cartridge 56 will be described. The photoreceptor cartridge 56 comprises a casing 57. A hole 57*a* which transmits a laser beam emitted by the exposure device 80 (to be described below) is formed between the casing 53 of the development cartridge 52 and the casing 57 of the photoreceptor cartridge 56. Further, a hole 57*b* for exposing the photoreceptor drum 64 (to be described below) downward is formed in a lower surface of the casing 57.

The photoreceptor drum 64 and a charger 70 are disposed in the casing 57 of the photoreceptor cartridge 56. The photoreceptor drum 64 contacts the lower side of the developing roller 62. The photoreceptor drum 64 comprises a photoreceptor drum main body 64*a* and a photoreceptor drum shaft 64*b*. The photoreceptor drum main body 64*a* has a cylindrical shape. The photoreceptor drum main body 64*a* is a positively-charged type. The surface of the photoreceptor drum main body 64*a* is constituted by polycarbonate or the like. The photoreceptor drum shaft 64*b* is made of metal. The photoreceptor drum shaft 64*b* is fixed to the casing 57 of the photoreceptor cartridge 56. The photoreceptor drum main body 64*a* is attached to the photoreceptor drum shaft 64*b* in a manner allowing its rotation. The photoreceptor drum main body 64*a* is connected to a drive source not shown in the drawing, and is rotated clockwise thereby. A part of the photoreceptor drum 64 is exposed (downward) to the exterior of the casing 57 through the hole 57*b*. When the printing sheet 2 is not carried on the belt 48, the lowermost end of the photoreceptor drum 64 contacts the belt 48. When the printing sheet 2 is carried on the belt 48, the lowermost end of the photoreceptor drum 64 contacts the printing sheet 2. The charger 70 is disposed on the left side of the photoreceptor drum 64. The charger 70 is disposed at a position which is downstream of the belt 48 and upstream of the developing roller 62 in the rotation direction of the photoreceptor drum 64. A gap is provided between the charger 70 and photoreceptor drum 64. The charger 70 is a scorotron type charger. The charger 70 comprises a wire 74. The wire 74 extends in a perpendicular direction to the paper surface of FIG. 2. A high voltage is applied to the wire 74. By applying a high voltage to the wire 74 to perform corona discharge, the surface of the photoreceptor drum 64 (the photoreceptor drum main body 64*a*) is positively charged.

The transfer roller 66 contacts the belt 48 on the back side of the belt 48. The transfer roller 66 is positioned directly below the photoreceptor drum 64. The transfer roller 66 comprises a transfer roller main body 66*a* and a transfer roller shaft 66*b*. The transfer roller main body 66*a* is formed from a conductive rubber material. The transfer roller shaft 66*b* is made of metal. The transfer roller shaft 66*b* is supported on the frame (not shown) of the printing sheet conveying device 40 in a manner allowing its rotation. The transfer roller shaft 66*b* is connected to a drive source not shown in the drawing. The transfer roller 66 rotates counterclockwise while the belt 48 rotates. The transfer roller shaft 66*b* is connected to a voltage supply circuit not shown in the drawing. During transfer (when the toner supported by the photoreceptor drum 64 is transferred onto the printing sheet 2), a bias is applied to the transfer roller 66 from the voltage supply circuit.

As shown in FIG. 1, the exposure device 80*a* is disposed on the left side of the development device 50*a*. Similarly, the exposure devices 80*b* to 80*d* are disposed respectively on the left side of the other development devices 50*b* to 50*d*. The exposure devices 80*a* to 80*d* have an identical structure. Here, the structure of the exposure device 80*a* will be described with reference to FIG. 2. In FIG. 2, the reference numeral 80 is used to represent the exposure devices 80*a* to 80*d*.

The exposure device 80 is fixed to the overall casing 12 (see FIG. 1). The exposure device 80 comprises a casing 82. A through hole 82*a* is formed in the right surface of the casing 82. A polygon mirror 84, a lens 86, a reflecting mirror 88, a reflecting mirror 90, a lens 92, a reflecting mirror 94, and so on are provided in the casing 82. The exposure device 80 comprises a light source not shown in the drawing. A laser beam is emitted from the light source based on the content of print data. The laser beam emitted from the light source is deflected by the polygon mirror 84 toward the lens 86. Having passed through the lens 86, the laser beam is reflected by the reflecting mirror 88. After being reflected by the reflecting mirror 88, the laser beam is reflected by the reflecting mirror 90 toward the lens 92. Having passed through the lens 92, the laser beam is reflected by the reflecting mirror 94. After being reflected by the reflecting mirror 94, the laser beam passes through the through hole 82*a* and proceeds rightward out of the casing 82. After emerging from the casing 82, the laser beam passes through the hole 57*a* between the development cartridge 52 and the photoreceptor cartridge 56 and reaches the photoreceptor drum 64. Thus the photoreceptor drum 64 is exposed to a predetermined pattern. The dot-dash line in FIG. 2 depicts the trajectory of the laser beam.

Next, the actions of the development device 50 and exposure device 80 will be described.

The toner stored in the toner chamber 53*a* is adhered to the supply roller 60. The toner adhered to the supply roller 60 is charged positively by the friction between the supply roller 60 and developing roller 62. The positively charged toner covers the surface of the developing roller 62.

Meanwhile, the surface of the photoreceptor drum main body 64*a* is charged positively by the charger 70. The surface of the positively charged photoreceptor drum main body 64*a* receives the laser beam emitted from the exposure device 80. Thus a predetermined part of the surface of the photoreceptor drum main body 64*a* is exposed. The electric potential of the exposed part of the photoreceptor drum main body 64*a* decreases. The part subjected to exposure varies according to the print content. An electrostatic latent image based on the print content is formed on the photoreceptor drum main body 64*a*.

The toner covering the developing roller 62 becomes adhered to the exposed part of the photoreceptor drum main body 64*a*. At this time, the toner does not become adhered to the non-exposed parts of the photoreceptor drum main body 64*a*. As a result, the electrostatic latent image formed on the photoreceptor drum main body 64*a* is transformed into a visible image.

The toner carried on the photoreceptor drum main body 64*a* is transferred onto the printing sheet 2 between the photoreceptor drum 64 and belt 48. At this time, a bias is applied to the transfer roller 66. The toner is transferred onto the printing sheet 2 by the voltage between the photoreceptor drum 64 and transfer roller 66.

In this embodiment, the four development devices 50*a* to 50*d* are used. Toner of each color is transferred onto the printing sheet 2 from the respective development devices 50*a* to 50*d*. Thus full color printing can be realized.

Next, returning to FIG. 1, the structure of the toner fixing device 100 will be described. The toner fixing device 100 is disposed to the left of the leftmost development device 50*d*. The toner fixing device 100 comprises two frames 102, 104 and two rollers 102*a*, 104*a*. The frame 102 supports the pressure roller 102*a* in a manner allowing its rotation. The frame 104 supports the heating roller 104*a* in a manner allowing its rotation.

The surface of the pressure roller 102*a* is formed from rubber. The pressure roller 102*a* is biased to the heating roller 104*a* side by a mechanism not shown in the drawing. The pressure roller 102*a* is not connected to a drive source. The pressure roller 102*a* rotates counterclockwise in response to clockwise rotation of the heating roller 104*a*.

A halogen lamp (not shown) is disposed in the interior of the heating roller 104*a*. The halogen lamp heats the heating roller 104*a*. The heating roller 104*a* is connected to a drive source not shown in the drawing, and is rotated clockwise thereby.

After being conveyed leftward by the printing sheet conveying device 40, the printing sheet 2 is guided along a rail not shown in the drawing, and inserted between the pressure roller 102*a* and heating roller 104*a* (arrow D4). When the heating roller 104*a* rotates clockwise, the printing sheet 2 between the pressure roller 102*a* and heating roller 104*a* is conveyed in the upward direction. The printing sheet 2 is heated by the high-temperature heating roller 104*a*. As a result, the toner transferred onto the printing sheet 2 is fixed by the heat. Having passed through the toner fixing device 100, the printing sheet 2 is conveyed in the upward direction.

A pair of eject rollers 110, 112 is disposed above the toner fixing device 100. The lower side eject roller 112 is connected to a drive source not shown in the drawing, and is rotated clockwise thereby. The upper side eject roller 110 is not connected to a drive source. When the lower side eject roller 112 rotates clockwise, the upper side eject roller 110 rotates counterclockwise in response thereto.

Having passed through the toner fixing device 100, the printing sheet 2 is guided along a rail not shown in the drawing, and inserted between the two eject rollers 110, 112. When the lower side eject roller 112 rotates clockwise, the printing sheet 2 between the two eject rollers 110, 112 is conveyed in the rightward direction (arrow D5). The printing sheet 2 is then conveyed to the exterior of the overall casing 12. An eject tray 116 is formed on the upper surface of the overall casing 12. Having been conveyed to the exterior of the overall casing 12, the printing sheet 2 is delivered onto the eject tray 116.

Next, the structure of the device 120 for cleaning the belt 48 will be described. The belt 48 contacts the printing sheet 2, and therefore paper particles of the printing sheet 2 may adhere to the belt 48. Furthermore, after a long period during which no printing is executed, the laser printer 10 of this embodiment executes an operation of transferring the toner from each of the photoreceptor drums 64 to the belt 48 prior to the next printing operation. The electrostatic charge of the toner following a long period during which no printing is executed differs from the electrostatic charge of the toner when printing is executed frequently. Hence, when printing has not been executed for a long time, the concentration of the toner transferred onto the printing sheet 2 differs. By transferring the toner onto the belt 48, the printer 10 of this embodiment checks the concentration of the toner of each color. When the toner concentration is not within a desired range, the voltage applied to the toner is altered. In other words, the applied voltage of the charger 70 is altered. Note that checking the toner concentration is a well-known technique, and hence a detailed description thereof has been omitted.

The belt cleaning device 120 removes the paper particles and toner adhered to the belt 48. The belt cleaning device 120 comprises a casing 122, three rollers 130, 132, 134, a blade 136, and so on. The casing 122 is disposed below the belt 48. A part of the upper surface of the casing 122 is open. The lower surface of the casing 122 may be opened by a mechanism not shown in the drawing. This structure allows the toner and paper particles that have accumulated in the casing 122 to be removed. The casing 122 houses the rollers 132, 134 and the blade 136.

Figure 3:
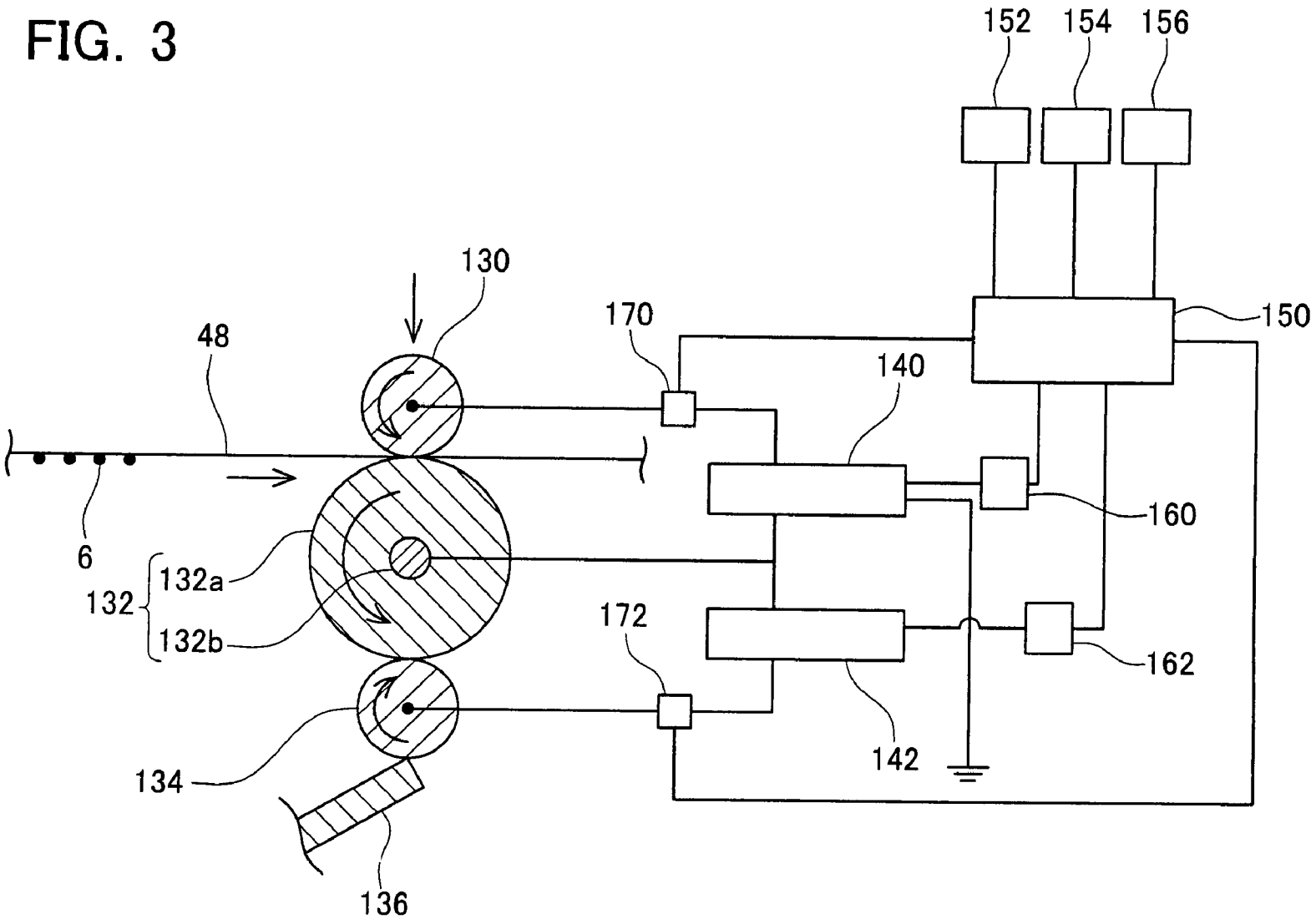
FIG. 3 shows a diagram illustrating a structure of a belt cleaning device.

Referring to FIG. 3, the structure of the three rollers 130, 132, 134 and the blade 136 will be described in detail.

The roller 130 will be referred to as a back roller. The back roller 130 contacts the back surface of the belt 48 on the lower side thereof. The back roller 130 is supported by a frame (not shown) of the printing sheet conveying device 40 (see FIG. 1) via a bearing. The bearing is biased downward. Thus the back roller 130 is biased in a downward direction. The back roller 130 is supported by the flame in a manner allowing its rotation. The back roller 130 rotates counterclockwise when the belt 48 rotates. The back roller 130 is made of metal, and the surface thereof is nickel plated. The back roller 130 is connected to a first high-voltage power circuit 140.

The roller 132 will be referred to as a first front roller. The first front roller 132 is exposed upward from an upper surface opening of the casing 122 (see FIG. 1). The first front roller 132 contacts the belt 48 on the front surface side of the belt 48. The first front roller 132 is disposed in a position facing the back roller 130. The first front roller 132 comprises a first front roller main body 132*a* and a first front roller shaft 132*b*. The first front roller main body 132*a* is formed from a foamed material. A silicone or urethane type material may be adopted as the foamed material. The first front roller shaft 132*b* is made of metal. The first front roller shaft 132*b* is supported by the casing 122 (see FIG. 1) in a manner allowing its rotation. A power source, not shown in the drawing, is connected to the first front roller 132. The first front roller 132 rotates counterclockwise when the belt 48 rotates. The first front roller shaft 132*b* is connected to the first high-voltage power circuit 140 and a second high-voltage power circuit 142.

The roller 134 will be referred to as a second front roller. The second front roller 134 contacts the lower side of the first front roller 132. The second front roller 134 is supported by the casing 122 (see FIG. 1) in a manner allowing its rotation. The second front roller 134 rotates clockwise when the belt 48 rotates (when the first front roller 132 rotates). The second front roller 134 is made of metal, and its surface is nickel-plated. The second front roller 134 is connected to the second high-voltage power circuit 142.

The blade 136 contacts the lower side of the second front roller 134. The blade 136 extends in a diagonally rightward and upward direction. The blade 136 is made of rubber. The blade 136 extends in a perpendicular direction to the paper surface of FIG. 3, and contacts the second front roller 134 over substantially the entire axis direction of the second front roller 134. The blade 136 knocks adhered paper particles and toner off from the second front roller 134. The paper particles and toner knocked off by the blade 136 drop onto the bottom surface of the interior of the casing 122. The paper particles and toner that have accumulated in the interior of the casing 122 can be removed by opening the bottom surface of the casing 122.

It is possible to omit the second front roller 134 by making the blade 136 contact the first front roller 132. However, since the surface of the first front roller 132 (the first front roller main body 132*a*) is constituted by a foamed material, the surface of the first front roller 132 would be damaged if the blade 136 makes contact with the first front roller 132. Cleaning must be performed without damaging the surface of the first front roller 132, and therefore the second front roller 134 is used. The second front roller 134 cleans the first front roller 132 using electric force. Thus the first front roller 132 can be cleaned without damage to its surface.

If the first front roller 132 were formed from metal, the surface of the first front roller 132 would not be damaged even when contacted by the blade 136. In so doing, the blade 136 could be brought into contact with the first front roller 132 and the second front roller 134 could be omitted. However, if the first front roller 132 were made of metal, the cleaning ability in relation to the belt 48 would be poorer than that of a foamed material, and therefore in this embodiment, the first front roller 132 is not made of metal.

In this embodiment, the two front rollers 132, 134 and the blade 136 are adopted in consideration of the circumstances described above.

The belt cleaning device 120 comprises a controller 150, the first high-voltage power circuit 140, the second high-voltage power circuit 142, a first D/A converter 160, a second D/A converter 162, and so on.

The controller 150 controls the voltage between the back roller 130 and first front roller 132, and the voltage between the first front roller 132 and second front roller 134. The first D/A converter 160 and second D/A converter 162 are connected to the controller 150. The controller 150 outputs a digital signal to the first D/A converter 160 to control the voltage between the back roller 130 and first front roller 132. The controller 150 also outputs a digital signal to the second D/A converter 162 to control the voltage between the first front roller 132 and second front roller 134. The content of the processing executed by the controller 150 will be described later.

The first D/A converter 160 inputs the digital signal output by the controller 150, converts the input digital signal into an analog signal (voltage), and outputs the converted analog signal to the first high-voltage power circuit 140. The second D/A converter 162 inputs the digital signal output by the controller 150, converts the input digital signal into an analog signal (voltage), and outputs the converted analog signal to the second high-voltage power circuit 142.

The first high-voltage power circuit 140 is connected to the back roller 130 and first front roller 132, and also earthed. The first high-voltage power circuit 140 inputs the analog signal (voltage) output by the first D/A converter 160, and amplifies the analog signal into a high voltage. As a result, a high voltage is applied between the back roller 130 and first front roller 132. In this embodiment, the potential of the back roller 130 is set to zero, and the potential of the first front roller 132 is set to a negative value.

The second high-voltage power circuit 142 is connected to the first front roller 132 and second front roller 134, and also earthed. The second high-voltage power circuit 142 inputs the analog signal (voltage) output by the second D/A converter 162, and amplifies the analog signal into a high voltage. As a result, a high voltage is applied between the first front roller 132 and second front roller 134. In this embodiment, the potential of the second front roller 134 is set to be lower than the potential of the first front roller 132.

Note that a first current sensor 170 is disposed between the back roller 130 and first high-voltage power circuit 140. A current value measured by the first current sensor 170 is equal to the current flowing between the back roller 130 and first front roller 132. Further, a second current sensor 172 is disposed between the second front roller 134 and second high-voltage power circuit 142. A current value measured by the second current sensor 172 is equal to the current flowing between the first front roller 132 and second front roller 134. The current sensors 170, 172 are connected to the controller 150. The controller 150 is capable of inputting the measurement values of the respective current sensors 170, 172.

According to the belt cleaning device 120 structured as described above, the potential of the first front roller 132 is lower than the potential of the back roller 130. Thus an electric field is generated from the back roller 130 in the direction of the first front roller 132. The toner 6 and paper particles adhered to the belt 48 receive an electrostatic force between the back roller 130 and first front roller 132 in the direction of the first front roller 132. As a result, the toner 6 and paper particles on the belt 48 are trapped by the first front roller 132, and the belt 48 is cleaned.

Further, the potential of the second front roller 134 is lower than the potential of the first front roller 132. Thus an electric field is generated from the first front roller 132 in the direction of the second front roller 134. The toner 6 adhered to the first front roller 132 receives an electrostatic force between the first front roller 132 and second front roller 134 in the direction of the second front roller 134. As a result, the toner 6 adhered to the first front roller 132 is trapped by the second front roller 134, and the first front roller 132 is cleaned.

The toner 6 and paper particles trapped by the second front roller 134 are knocked off by the blade 136. Thus the second front roller 134 is cleaned.

Note that a toner exchange sensor 152, a counter 154, and a memory 156 are connected to the controller 150.

The toner exchange sensor 152 outputs a toner exchange signal when the development cartridge 52 is exchanged for a new one. When the toner exchange signal is input into the controller 150, the controller 150 learns that the toner has been exchanged.

The counter 154 counts the number of printing sheets printed by the laser printer 10. The value of the counter 154 is latched by the controller 150.

The storage content of the memory 156 will be described later in a second embodiment and so on. The actions of the counter 154 and memory 156 will be described in detail in the second embodiment.

Figure 4:
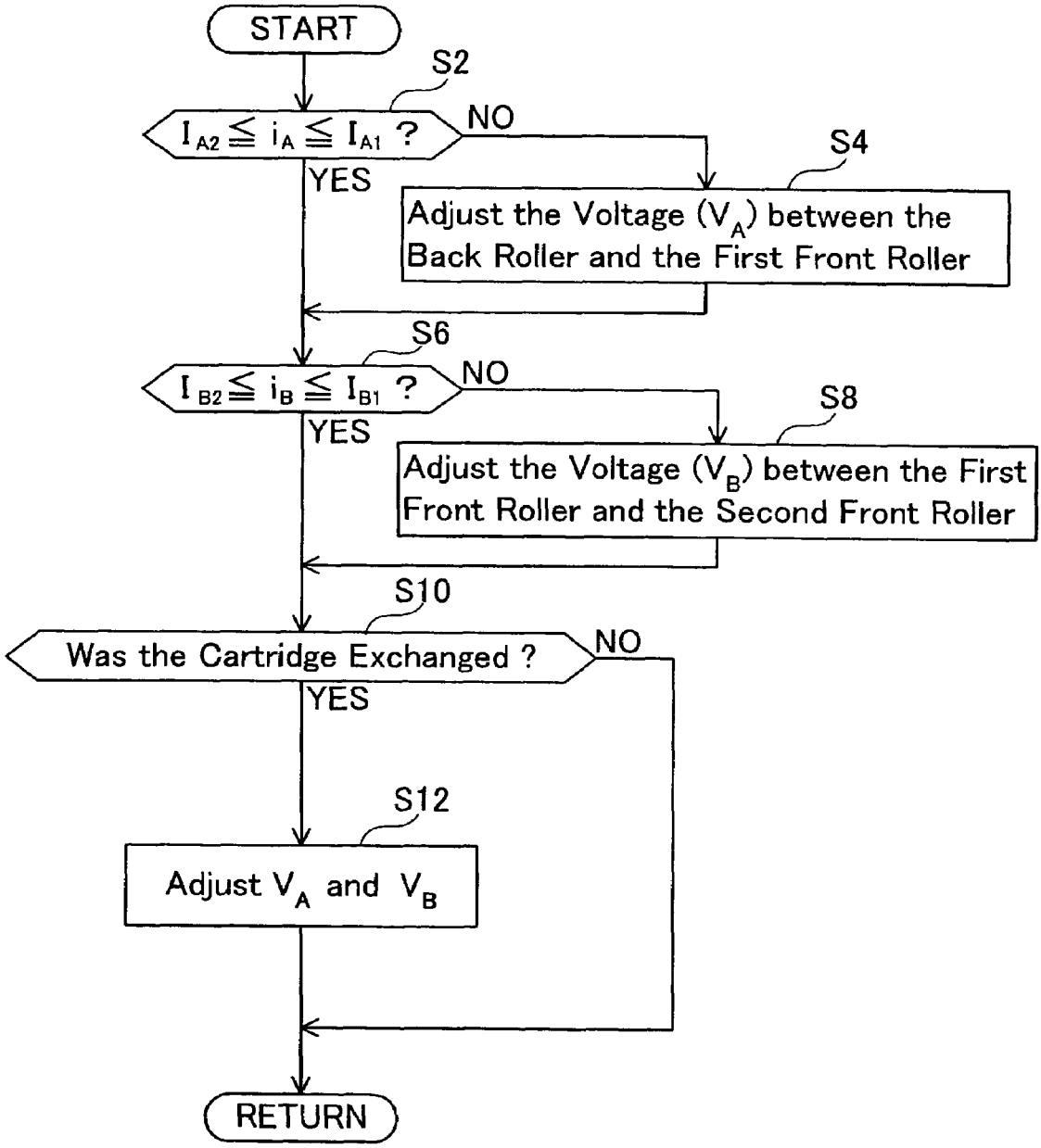
FIG. 4 shows a flowchart illustrating voltage adjustment process executed by a controller.

Next, referring to FIG. 4, the manner in which the controller 150 performs voltage control will be described. FIG. 4 is a flowchart of voltage control process executed by the controller 150.

The controller 150 monitors the measurement value of the first current sensor 170 (step S2). More specifically, the controller 150 monitors a current $i_A$ flowing between the back roller 130 and first front roller 132. When the current $i_A$ is not within a range of $I_{A2}$ to $I_{A1}$ (NO in the step S2), the routine advances to S4. In S4, a voltage $V_A$ between the back roller 130 and first front roller 132 is adjusted. Here, the voltage $V_A$ is adjusted to make the current $i_A$ an intermediate value $I_{Am}$ between $I_{A2}$ and $I_{A1}$ (i.e. $I_{Am}$ is a value obtained by dividing the sum of $I_{A2}$ and $I_{A1}$ by 2). This adjustment is performed specifically in the following manner. The present voltage $V_A$ between the back roller 130 and first front roller 132 is known. The present current $i_A$ flowing between the back roller 130 and first front roller 132 is also known. Hence, a present resistance $R_A$ between the back roller 130 and first front roller 132 can be calculated ($R_A=V_A/i_A$). Next, a target voltage between the back roller 130 and first front roller 132 is obtained by multiplying $R_A$ by $I_{Am}$ (an intermediate value between $I_{A2}$ and $I_{A1}$). The controller 150 outputs a digital signal corresponding to the target voltage to the first D/A converter 160. Thus the voltage between the back roller 130 and first front roller 132 is adjusted to the target voltage. The current flowing between the back roller 130 and first front roller 132 becomes the intermediate value $I_{Am}$ between $I_{A2}$ and $I_{A1}$. Note that the manner in which $I_{A2}$ and $I_{A1}$ are set will be described later.

When the step S4 is complete, the routine advances to a step S6. The routine also advances to S6 when it is determined in the step S2 that the current $i_A$ is within the range of $I_{A2}$ to $I_{A1}$. In the step S6, the value of the second current sensor 172 is monitored. More specifically, a current $i_B$ flowing between the first front roller 132 and second front roller 134 is monitored. When the current $i_B$ is not within a range of $I_{B2}$ to $I_{B1}$ (NO in the step S6), the routine advances to S8. In S8, a voltage $V_B$ between the first front roller 132 and second front roller 134 is adjusted. Here, the voltage $V_B$ is adjusted to make the current $i_B$ an intermediate value $I_{Bm}$ between $I_{B2}$ and $I_{B1}$. This adjustment is performed specifically in the following manner. The present voltage $V_B$ between the first front roller 132 and second front roller 134 is known. The present current $i_B$ flowing between the first front roller 132 and second front roller 134 is also known. Hence, a present resistance $R_B$ between the first front roller 132 and second front roller 134 can be calculated ($R_B=V_B/i_B$). Next, a target voltage between the first front roller 132 and second front roller 134 is obtained by multiplying $R_B$ by $I_{Bm}$. The controller 150 outputs a digital signal corresponding to the target voltage to the second D/A converter 162. Thus the voltage between the first front roller 132 and second front roller 134 is adjusted to the target voltage. The current flowing between the first front roller 132 and second front roller 134 becomes the intermediate value $I_{Bm}$ between $I_{B2}$ and $I_{B1}$. The manner in which $I_{B2}$ and $I_{B1}$ are set will be described later.

Once the step S8 is complete, the routine advances to a step S10. The routine also advances to S10 when it is determined in the step S6 that the current $i_B$ is within the range of $I_{B2}$ to $I_{B1}$. In the step S10, a determination is made as to whether or not the development cartridge 52 (see FIG. 2) has been exchanged. When the toner exchange signal output by the toner exchange sensor 152 (see FIG. 3) has been input into the controller 150, the controller 150 determines YES in the step S10. Upon a determination of YES in the step S10, the routine advances to a step S12.

In the step S12, the voltage $V_A$ between the back roller 130 and first front roller 132 is adjusted, and the voltage $V_B$ between the first front roller 132 and second front roller 134 is adjusted. This adjustment is performed specifically in the following manner. First, $V_A$ is adjusted such that the current $i_A$ matches $I_{A1}$. A target voltage can be obtained by obtaining the present resistance $R_A$ between the back roller 130 and first front roller 132 ($R_A=V_A/i_A$), and multiplying $R_A$ by $I_{A1}$. The controller 150 outputs a digital signal corresponding to the target voltage to the first D/A converter 160. As a result, the voltage between the back roller 130 and first front roller 132 is adjusted to the target voltage, and the current flowing between the back roller 130 and first front roller 132 becomes $I_{A1}$.

Further, the voltage $V_B$ between the first front roller 132 and second front roller 134 is adjusted such that the current $i_B$ matches $I_{B1}$. A target voltage can be obtained by obtaining the present resistance $R_B$ between the first front roller 132 and second front roller 134 ($R_B=V_B/i_B$), and multiplying $R_B$ by $I_{B1}$. The controller 150 outputs a digital signal corresponding to the target voltage to the second D/A converter 162. As a result, the voltage between the first front roller 132 and second front roller 134 is adjusted to the target voltage, and the current flowing between the first front roller 132 and second front roller 134 becomes $I_{B1}$.

After the controller 150 has executed the step S12 or determined NO in the step S10, the routine returns to the step S2.

Next, the manner in which above described $I_{A1}$, $I_{A2}$, $I_{B1}$, and $I_{B2}$ are set will be described. The relationship between the magnitude of the voltage between the back roller 130 and first front roller 132, and the cleaning ability of the first front roller 132 in relation to the belt 48 was obtained through experiment in a case where the resistance between the back roller 130 and first front roller 132 was constant. Further, the relationship between the magnitude of the voltage between the first front roller 132 and second front roller 134, and the cleaning ability of the second front roller 134 in relation to the first front roller 132 was obtained through experiment in a case where the resistance between the first front roller 132 and second front roller 134 was constant.

Figure 5:
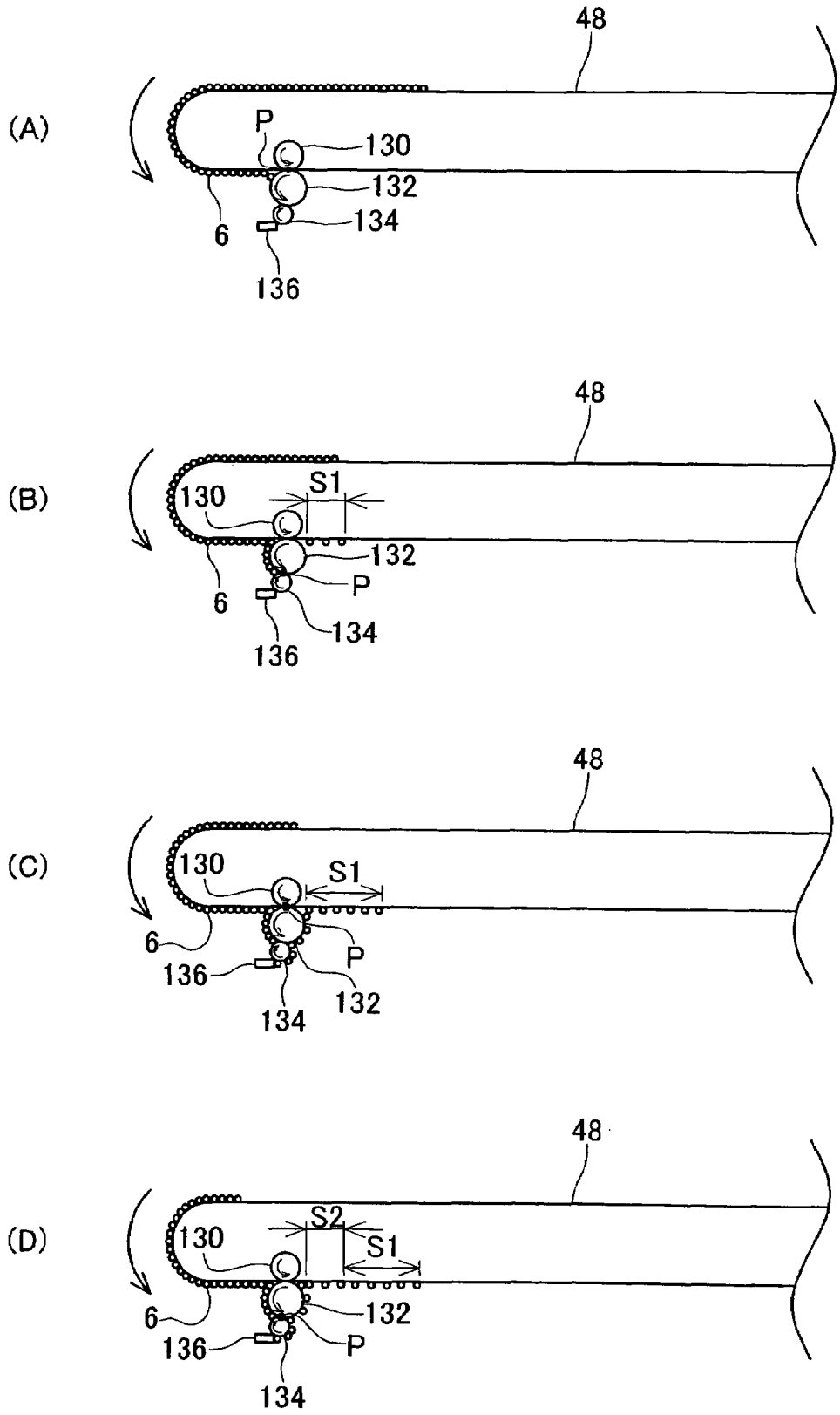
FIG. 5 shows a view for explaining an experiment performed to evaluate cleaning ability.

Referring to FIG. 5, the methods of these experiments will be described. First, transparent adhesive tape was affixed to a new belt 48 free from adhered toner. The adhesive tape was then removed from the belt 48. The removed adhesive tape was set in a digital reflection densitometer and the density thereof was measured. Note that hereafter, this density will be referred to as a reference density.

Next, the toner 6 was adhered to the new belt 48 (FIG. 5A). Three new rollers 130, 132, 134 were prepared. The voltage between the back roller 130 and first front roller 132 was set to −0.2 kV. The voltage between the first front roller 132 and second front roller 134 was set to −0.2 kV. The belt 48 adhered with the toner 6 was rotated, and the three rollers 130, 132, 134 were rotated. The toner 6 on the belt 48 was trapped by the first front roller 132 (FIG. 5B). Note that in FIG. 5A, a point P on the first front roller 132 indicates the point of contact with the tip of the toner adhered part of the belt 48. When the point P enters the state shown in FIG. 5B, this point P is located at a position where the point P makes contact with the second front roller 134. In the state shown in FIG. 5B, the toner 6 trapped on the first front roller 132 has not yet been removed by the second front roller 134.

In the state in FIG. 5B, the part of the belt 48 that has passed the first front roller 132 is shown by a reference symbol S1. Adhesive tape was affixed to the S1 part. The adhesive tape was removed from the belt 48, and the removed adhesive tape was set in the digital reflection densitometer to measure its density. Note that hereafter, this density will be referred to as a first measured density. When a large amount of toner remains in the part S1, the first measured density increases. Conversely, when little toner remains in the S1 part, the first measured density decreases. In other words, the cleaning ability of the first front roller 132 in relation to the belt 48 is indicated to be steadily more favorable as the first measured density is low.

Figure 6:
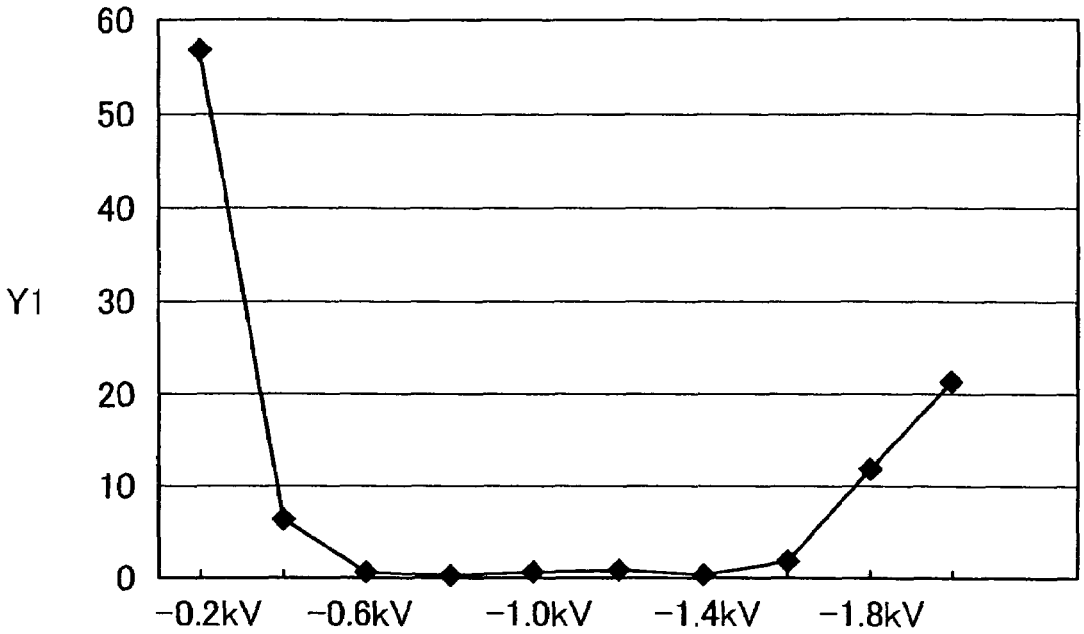
FIG. 6 shows a relationship between voltage between a back roller and a first front roller, and the cleaning ability of the first front roller.

By performing the above experiment under various voltages between the back roller 130 and first front roller 132, the relationship between the magnitude of the voltage between these rollers 130, 132, and the cleaning ability of the first front roller 132 in relation to the belt 48 can be obtained. The results thereof are shown in FIG. 6. The abscissa of FIG. 6 is the potential of the first front roller 132 relative to the potential of the back roller 130. The ordinate of FIG. 6 is the difference (Y1) between the reference density and first measured density. As Y1 is low, the first measured density is low, indicating that the cleaning ability of the first front roller 132 is favorable. As is evident from FIG. 6, when the voltage between the back roller 130 and first front roller 132 is too small, the cleaning ability of the first front roller 132 deteriorates. The cleaning ability of the first front roller 132 also deteriorates when the voltage between the back roller 130 and first front roller 132 is too large. In this embodiment, if the resistance between the back roller 130 and first front roller 132 has a predetermined value ($R_{s1}$) and the voltage between the rollers 130, 132 is within a range of −0.4 kV to −1.6 kV, the first front roller 132 is evaluated as exhibiting an excellent cleaning performance. The resistance $R_{s1}$, between the new back roller 130 and the new first front roller 132 was measured in advance. $I_{A1}$ (see FIG. 4) was obtained by dividing −0.4 kV by $R_{s1}$, and $I_{A2}$ (see FIG. 4) was obtained by dividing −1.6 kV by $R_{s1}$.

The first front roller 132 cannot be cleaned completely by the second front roller 134. The first front roller 132 becomes soiled over time. When the first front roller 132 becomes soiled, the electric resistance thereof increases. When the voltage between the back roller 130 and first front roller 132 is fixed and the electric resistance of the first front roller 132 increases, it becomes difficult for current to flow between the rollers 130, 132. In this case, the cleaning ability of the first front roller 132 deteriorates. It has been discovered as a result of research performed by the present inventors that, even when the electric resistance of the first front roller 132 increases, the first front roller 132 can be made to exhibit an excellent cleaning performance continuously by keeping the current flowing between the back roller 130 and first front roller 132 within the range of $I_{A2}$ to $I_{A1}$.

In this embodiment, when the electric resistance of the first front roller 132 increases, the voltage $V_A$ between the back roller 130 and first front roller 132 is increased to keep the current within the range of $I_{A2}$ to $I_{A1}$. As a result, the first front roller 132 exhibits an excellent cleaning performance at all times.

When the belt 48 is rotated further from the state shown in FIG. 5B, the state shown in FIG. 5C is reached. In this state, the point P on the first front roller 132 has performed one revolution and moved back into contact with the belt 48. The part of the first front roller 132 following the point P is cleaned by the second front roller 134. Following the state shown in FIG. 5C, the first front roller 132 cleaned by the second front roller 134 cleans the belt 48. FIG. 5D shows a state following the state shown in FIG. 5C. In this state, the part of the belt 48 cleaned by the first front roller 132 that has been cleaned by the second front roller 134 is shown by a reference symbol S2. Adhesive tape was affixed to the S2 part. The adhesive tape was removed from the belt 48, and the removed adhesive tape was set in the digital reflection densitometer to measure its density. Note that hereafter, this density will be referred to as a second measured density. When a large amount of toner remains in the part S2, the second measured density increases, and when no toner remains in the S2 part, the second measured density decreases. When the second measured density is low, this indicates that the first front roller 132 has been cleaned thoroughly, and hence that the cleaning ability of the second front roller 134 is favorable.

Figure 7:
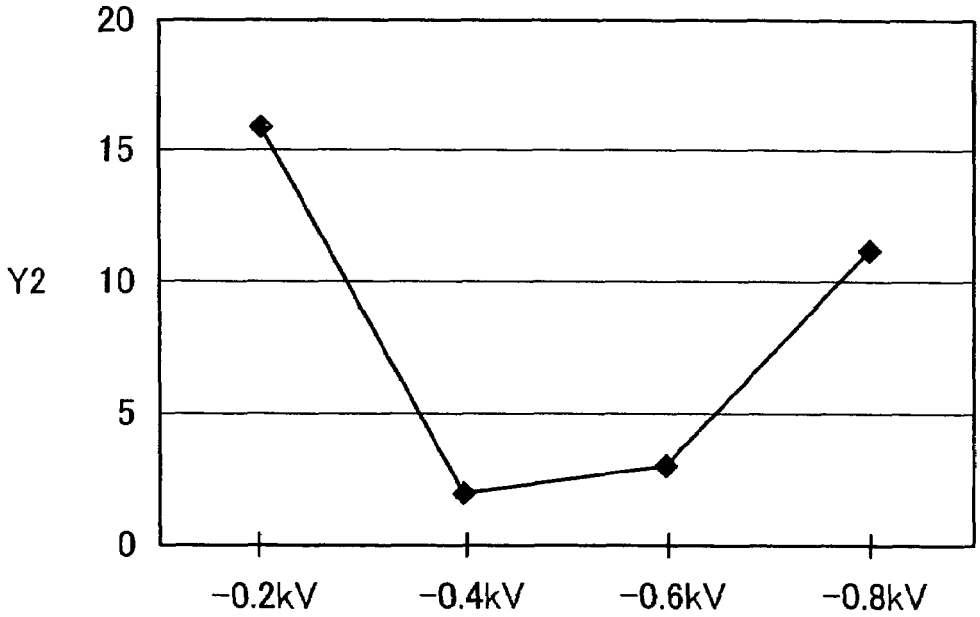
FIG. 7 shows a relationship between voltage between the first front roller and a second front roller, and the cleaning ability of the second front roller.

By performing the above experiment under various voltages between the first front roller 132 and second front roller 134, the relationship between the magnitude of the voltage between the first front roller 132 and second front roller 134, and the cleaning ability of the second front roller 134 in relation to the first front roller 132 can be obtained. The results thereof are shown in FIG. 7. The abscissa of FIG. 7 is the potential of the second front roller 134 relative to the potential of the first front roller 132. The ordinate of FIG. 7 is the difference (Y2) between the reference density and second measured density. As Y2 is low, the second measured density is low, indicating that the cleaning ability of the second front roller 134 is favorable. When the voltage between the first front roller 132 and second front roller 134 is too small, the cleaning ability of the second front roller 134 deteriorates. The cleaning ability of the second front roller 134 also deteriorates when the voltage between the first front roller 132 and second front roller 134 is too large. In this embodiment, if the resistance between the first front roller 132 and second front roller 134 has a predetermined value ($R_{s2}$) and the voltage between the rollers 132, 134 is within a range of −0.4 kV to −0.8 kV, the second front roller 134 is evaluated as exhibiting an excellent cleaning performance. The resistance $R_{s2}$ between the new first front roller 132 and the new second front roller 134 was measured in advance. $I_{B1}$ (see FIG. 4) was obtained by dividing −0.4 kV by $R_{s2}$, and $I_{B2}$ (see FIG. 4) was obtained by dividing −0.8 kV by $R_{s2}$.

The second front roller 134 is cleaned by the blade 136, but becomes soiled over time. When the second front roller 134 becomes soiled, the electric resistance thereof increases. When the voltage between the first front roller 132 and second front roller 134 is fixed and the electric resistance of the first front roller 132 or the second front roller 134 increases, it becomes difficult for current to flow between the rollers 132, 134. In this case, the cleaning ability of the second front roller 134 deteriorates. It has been discovered as a result of research performed by the present inventors that, even when the electric resistance of the second front roller 134 increases, the second front roller 134 can be made to exhibit an excellent cleaning performance continuously by keeping the current flowing between the first front roller 132 and second front roller 134 within the range of $I_{B2}$ to $I_{B1}$.

In this embodiment, when the electric resistance of the second front roller 134 increases, the voltage between the first front roller 132 and second front roller 134 is increased to keep the current within the range of $I_{B2}$ to $I_{B1}$. As a result, the second front roller 134 exhibits an excellent cleaning performance at all times.

The cleaning ability of the first front roller 132 is dependent on the magnitude of the current flowing between the back roller 130 and the first front roller 132. In this embodiment, the current flowing between the back roller 130 and the first front roller 132 is maintained within a range ($I_{A2}$ to $I_{A1}$) at which the first front roller 132 exhibits an excellent cleaning performance. Even when the first front roller 132 becomes soiled with paper particles and toner such that the electric resistance of the first front roller 132 increases, the current flowing between the back roller 130 and first front roller 132 is maintained within $I_{A2}$ to $I_{A1}$. According to the laser printer 10 of this embodiment, the cleaning ability of the first front roller 132 can be maintained at a high level.

Further, the cleaning ability of the second front roller 134 is dependent on the magnitude of the current flowing between the first front roller 132 and second front roller 134. The current flowing between the first front roller 132 and second front roller 134 is maintained within a range ($I_{B2}$ to $I_{B1}$) at which the second front roller 134 exhibits an excellent cleaning performance. Even when the second front roller 134 becomes soiled such that the electric resistance of the second front roller 134 increases, the current flowing between the first front roller 132 and second front roller 134 is maintained within $I_{B2}$ to $I_{B1}$. Hence, the cleaning ability of the second front roller 134 can be maintained at a high level.

Figures 8, 9:
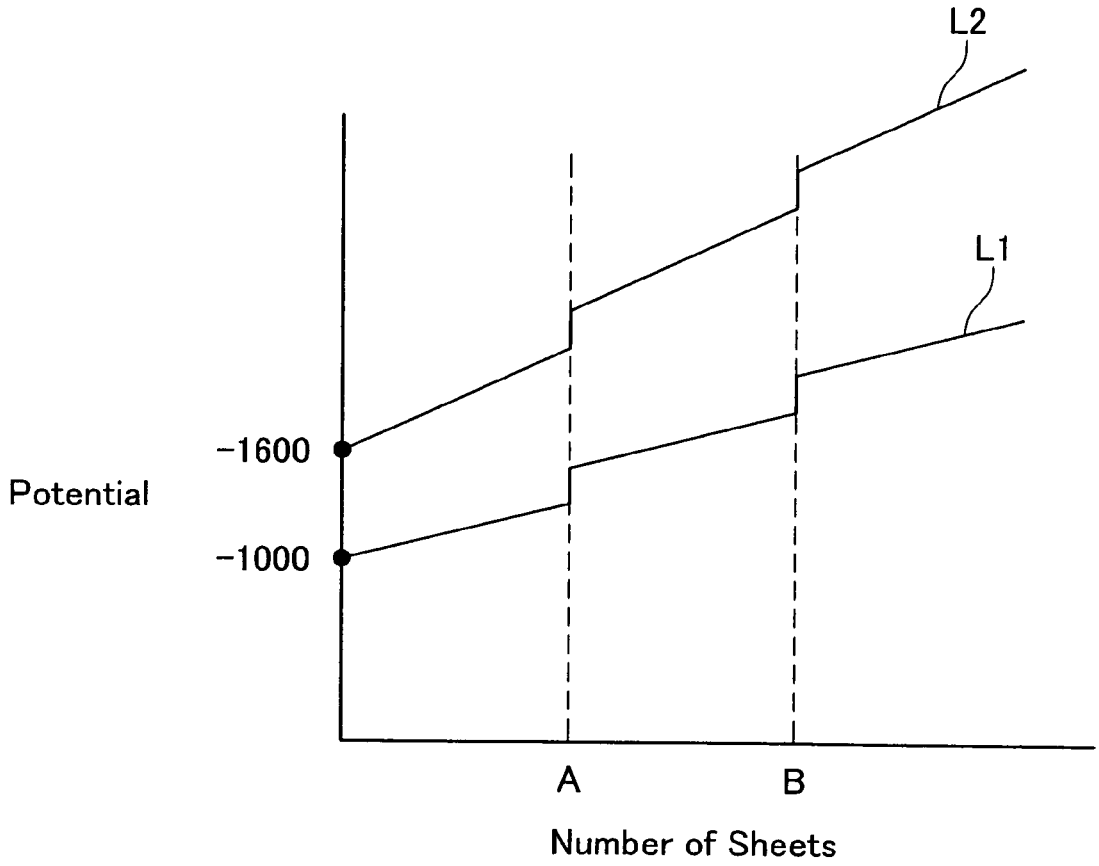
FIG. 8 shows a manner in which an electric potential of the first front roller and an electric potential of the second front roller vary over time.
FIG. 9 shows storage content of a memory according to a second embodiment.

FIG. 8 shows the manner in which the potentials of the first front roller 132 and second front roller 134 change over time when the laser printer 10 of this embodiment is used. The abscissa of FIG. 8 shows the number of printing sheets having been printed, and the ordinate shows the potential. A graph L1 shows the potential of the first front roller 132, while a graph L2 shows the potential of the second front roller 134. Note that the potential of the back roller 130 is maintained at zero.

As is evident from the graph L1, the potential of the first front roller 132 decreases steadily as the number of printed sheets increases. This means that the potential difference (voltage) between the back roller 130 and first front roller 132 increases over time. When the number of printed sheets reaches A and B, the potential of L1 changes greatly. This indicates that the development cartridge 52 (see FIG. 2) has been exchanged for a new one. When the development cartridge 52 is exchanged for a new one such that new toner is used, it becomes difficult for the first front roller 132 to trap the toner. It was learned from an experiment performed by the present inventors that, within the current range ($I_{A2}$ to $I_{A1}$) at which the first front roller 132 exhibits an excellent cleaning performance, it is easier for the first front roller 132 to trap new toner with a large current. Hence in this embodiment, when new toner is replenished, the voltage between the back roller 130 and first front roller 132 is increased such that the current flowing between these rollers 130, 132 reaches $I_{A1}$ (see FIG. 4). As a result, the first front roller 132 is able to trap new toner efficiently.

The potential of the second front roller 134 decreases over time (L2 in FIG. 8). The voltage (the difference between L1 and L2) between the first front roller 132 and second front roller 134 increases over time. When the development cartridge 52 (see FIG. 2) is exchanged for a new one, the potential difference between the first front roller 132 and second front roller 134 increases greatly (when the number of printed sheets reaches A and B). At the timings A and B, a change amount of L2 is greater than a change amount of L1. That is, a potential difference (voltage) between the first front roller 132 and second front roller 134 increases at the timing A and B. It was learned from an experiment performed by the present inventors that, within the current range ($I_{B2}$ to $I_{B1}$) at which the second front roller 134 exhibits an excellent cleaning performance, it is easier for the second front roller 134 to trap new toner with a large current. Hence in this embodiment, when new toner is replenished, the voltage between the first front roller 132 and second front roller 134 is increased such that the current flowing between these rollers 132, 134 reaches $I_{B1}$ (see FIG. 4). As a result, the second front roller 134 is able to trap new toner efficiently.

In the laser printer 10 of this embodiment, the voltage between the back roller 130 and first front roller 132 is subjected to constant current control, and hence the cleaning performance of the first front roller 132 in relation to the belt 48 is favorable. The voltage between the first front roller 132 and second front roller 134 is also subjected to constant current control, and hence the cleaning performance of the second front roller 134 in relation to the first front roller 132 is also favorable. By keeping the first front roller 132 clean, the first front roller 132 is able to clean the belt 48 efficiently and continuously. The ability of the laser printer 10 of this embodiment to clean the belt 48 is therefore extremely high.

Second Embodiment

Here, description will focus on parts that are different to the first embodiment. In this embodiment, the controller 150 does not monitor $i_A$ and $i_B$. The controller 150 varies the voltage between the back roller 130 and first front roller 132, and the voltage between the first front roller 132 and second front roller 134 in accordance with information stored in the memory 156 (see FIG. 3). FIG. 9 shows an example of the information stored in the memory 156. The word "Sheets" in the drawing shows the number of printed sheets. The term "Potential1" shows the potential of the first front roller 132. The term "Potential2" shows the potential of the second front roller 134. Note that the potential of the back roller 130 is maintained at zero.

The controller 150 of this embodiment monitors the number of printed sheets, which is counted by the counter 154 (see FIG. 3). When the count value reaches the number of printed sheets stored in the memory 156, the controller 150 adjusts the potentials to values corresponding to the number of printed sheets. For example, when the number of printed sheets reaches 10,000, the potential of the first front roller 132 is adjusted to −1050V and the potential of the second front roller 134 is adjusted to −1700V. In other words, the voltage between the back roller 130 and first front roller 132 is adjusted to 1050V, and the voltage between the first front roller 132 and second front roller 134 is adjusted to 650V.

According to this embodiment, the current sensors 170, 172 are unnecessary. In this embodiment also, the cleaning ability of the first front roller 132 and second front roller 134 can be maintained at a high level.

Third Embodiment

Figure 10:
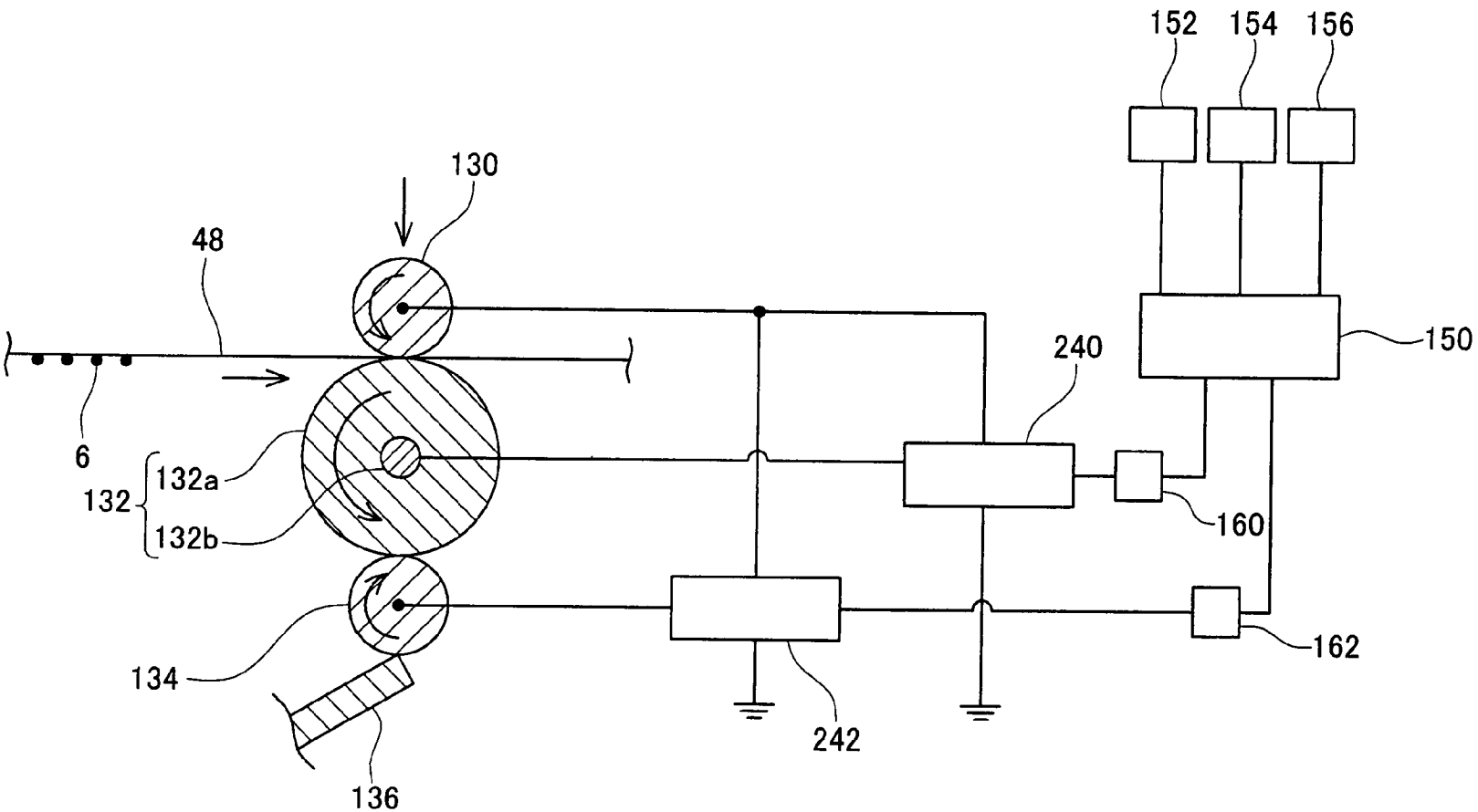
FIG. 10 shows a diagram illustrating a structure of a belt cleaning device according to a third embodiment.

In this embodiment, description will focus on parts that are different to the first embodiment. FIG. 10 is a diagram illustrating the structure of the belt cleaning device 120 of this embodiment. In FIG. 10, identical elements to those of the first embodiment have been allocated identical reference symbols.

A first high-voltage power circuit 240 is connected to the back roller 130 and also connected to the first front roller 132. The first high-voltage power circuit 240 applies a voltage between the back roller 130 and first front roller 132 by applying a negative potential to the first front roller 132. Note that the potential of the back roller 130 is maintained at zero.

A second high-voltage power circuit 242 is connected to the back roller 130 and also connected to the second front roller 134. The second high-voltage power circuit 242 applies a high voltage between the back roller 130 and second front roller 134 by applying a negative potential to the second front roller 134. As a result, the voltage between the first front roller 132 and second front roller 134 is adjusted.

In this embodiment also, the voltage between the back roller 130 and first front roller 132 can be adjusted, and the voltage between the first front roller 132 and second front roller 134 can also be adjusted.

Fourth Embodiment

In this embodiment, description will focus on parts that are different to the first embodiment. In the first embodiment, the voltage between the first front roller 132 and second front roller 134 increases steadily as the number of printed sheets increases. However, when the second front roller 134 does not easily become soiled, the voltage between the first front roller 132 and second front roller 134 may be maintained at a constant value. In this case, only the voltage between the back roller 130 and first front roller 132 is subjected to constant current control.

Figure 11:
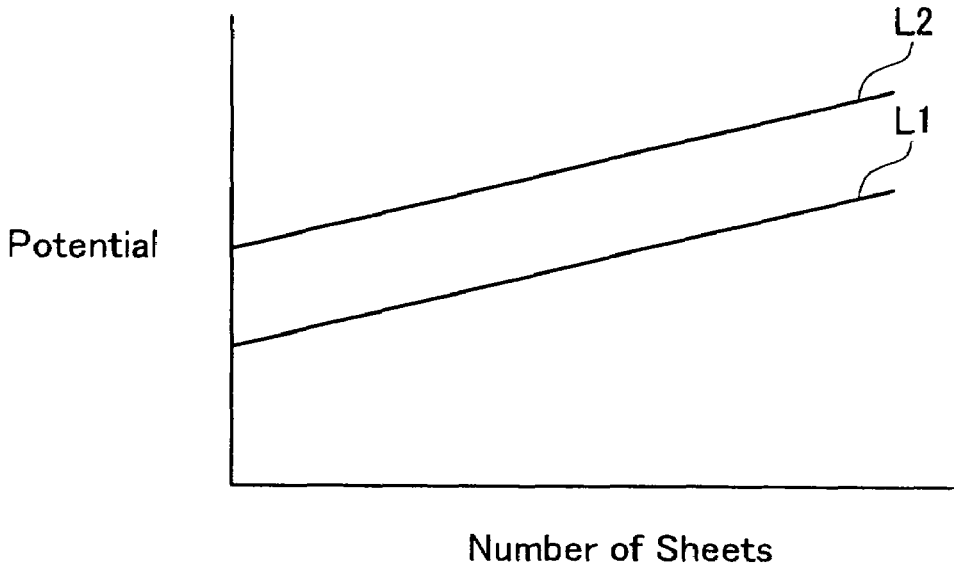
FIG. 11 shows a manner in which an electric potential of the first front roller and an electric potential of the second front roller vary over time (fourth embodiment).

FIG. 11 shows the relationship between the number of printed sheets and the potentials in this embodiment. The abscissa in FIG. 11 shows the number of printed sheets. The ordinate shows negative potentials, the absolute values of which increase as the values of the ordinate increase. L1 shows the potential of the first front roller 132. L2 shows the potential of the second front roller 134. The voltage between the first front roller 132 and second front roller 134 is constant.

Fifth Embodiment

In the fourth embodiment, the voltage between the first front roller 132 and second front roller 134 is maintained at a constant value. When the first front roller 132 does not easily become soiled, the voltage between the back roller 130 and first front roller 132 may be maintained at a constant value. In this case, only the voltage between the first front roller 132 and second front roller 134 is subjected to constant current control.

Figure 12:
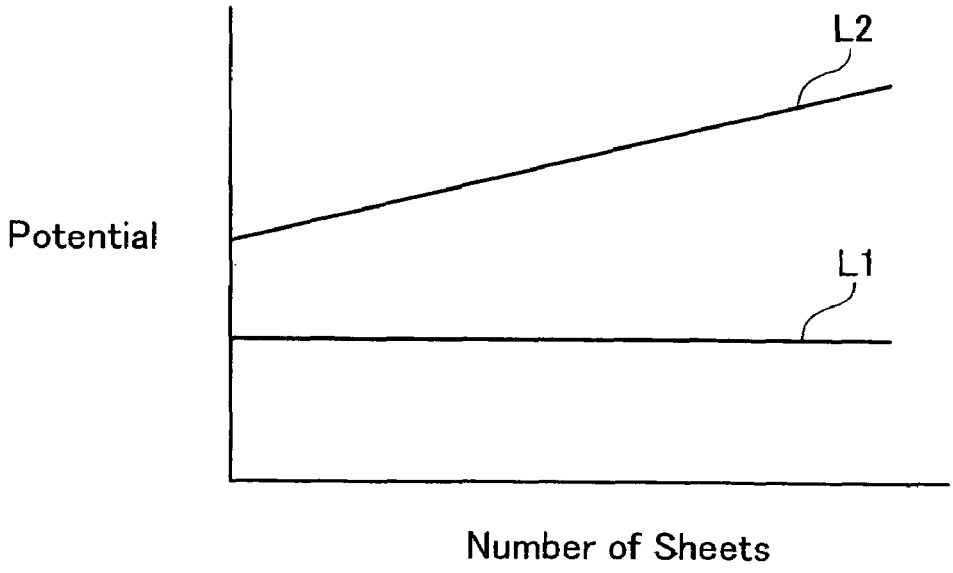
FIG. 12 shows a manner in which an electric potential of the first front roller and an electric potential of the second front roller vary over time (fifth embodiment).

FIG. 12 shows the relationship between the number of printed sheets and the potential in this embodiment. The abscissa in FIG. 12 shows the number of printed sheets. The ordinate shows negative potentials, the absolute values of which increase as the values of the ordinate increase. L1 shows the potential of the first front roller 132. L2 shows the potential of the second front roller 134. The voltage between the back roller 130 and the first front roller 132 is constant.

Sixth Embodiment

Figure 13:
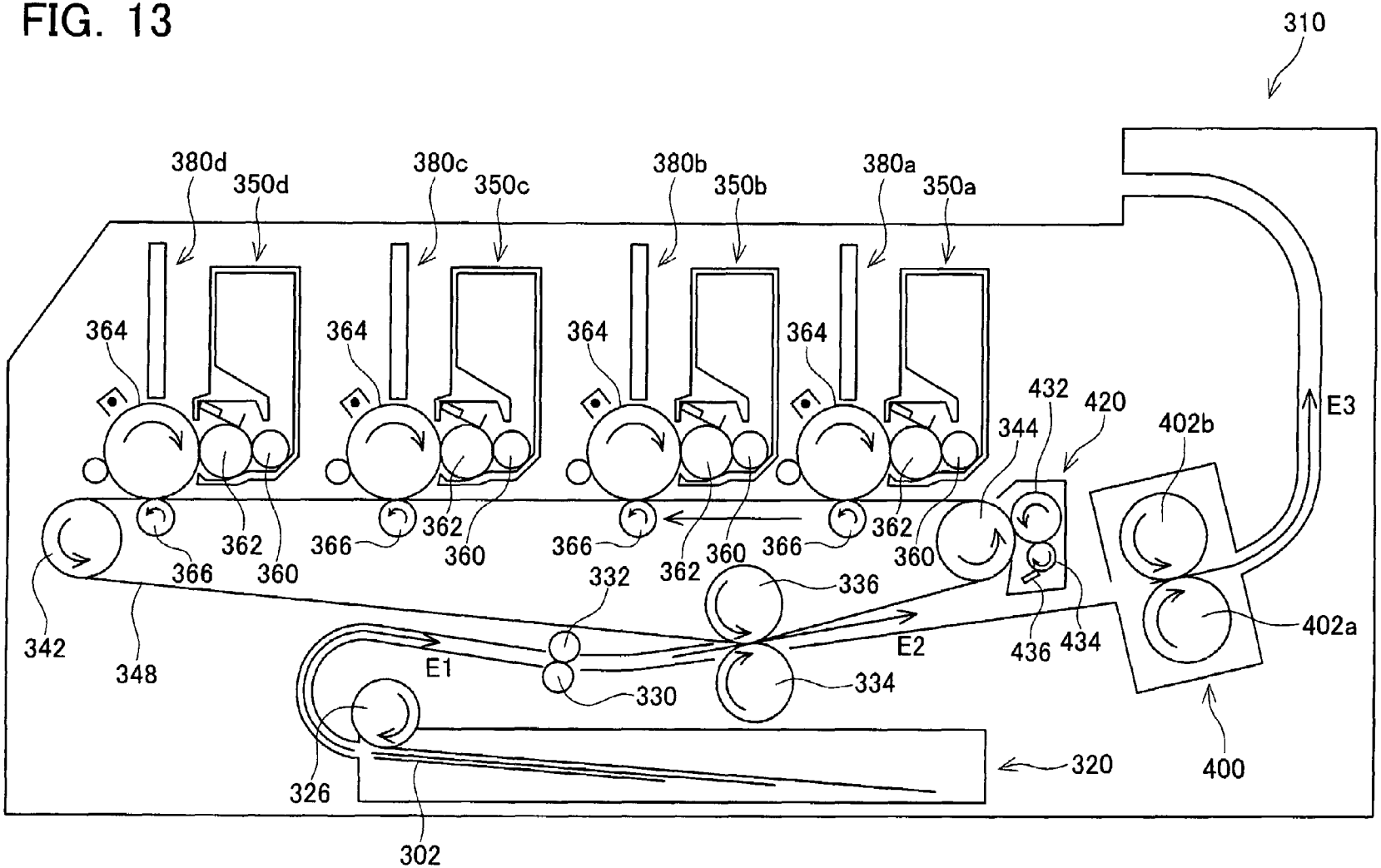
FIG. 13 shows a schematic side view of a laser printer according to a sixth embodiment.

Referring to FIG. 13, a laser printer 310 of this embodiment will be described. The laser printer 310 is a secondary transfer type. In other words, in this laser printer 310, toner is transferred from a photoreceptor drum 364 to an intermediate transfer belt 348 (primary transfer), whereupon the primary-transferred toner is transferred from the intermediate transfer belt 348 to a sheet of printing sheet 302 (secondary transfer).

The structure of the laser printer 310 will be described below. Identical names have been used for members that are similar to those of the first embodiment, and detailed description thereof has been omitted. Furthermore, the rotation direction of each roller is indicated in the drawing, and hence detailed description relating to the rotation direction has been omitted.

The laser printer 310 comprises a paper feeding device 320. The printing sheet 302 stored in the paper feeding device 320 is conveyed in the direction of an arrow E1 by a paper feeding roller 326. The printing sheet 302 conveyed in the direction of the arrow E1 is inserted between two conveyance rollers 330, 332. The printing sheet 302 between the two conveyance rollers 330, 332 is conveyed rightward.

Printing sheet transfer rollers 334, 336 are provided to the right of the conveyance rollers 330, 332. Having been conveyed rightward by the conveyance rollers 330, 332, the printing sheet 302 is inserted between the printing sheet transfer rollers 334, 336 (arrow E2). The lower side printing sheet transfer roller 334 contacts the front surface side of the intermediate transfer belt 348. The upper side printing sheet transfer roller 336 contacts the back surface side of the intermediate transfer belt 348. The printing sheet transfer roller 334 is connected to a voltage supply circuit not shown in the drawing. When the toner is to be transferred onto the printing sheet 302 from the intermediate transfer belt 348, a transfer bias is applied to the printing sheet transfer roller 334. The printing sheet transfer rollers 334, 336 are disposed facing each other.

A toner fixing device 400 is provided to the right of the printing sheet transfer rollers 334, 336. The toner fixing device 400 comprises a pressure roller 402*a* and a heating roller 402*b*. Having been conveyed in the direction of the arrow E2, the printing sheet 302 is inserted between the pressure roller 402*a* and heating roller 402*b*. The toner transferred onto the printing sheet 302 is fixed on the printing sheet 302 by heat. Having passed through the toner fixing device 400, the printing sheet 302 is conveyed in the direction of an arrow E3 and ejected. The laser printer 310 comprises the intermediate transfer belt 348 and two belt rollers 342, 344. The belt roller 344 is connected to the ground of a voltage supply circuit not shown in the drawing.

The laser printer 310 comprises four development devices 350*a* to 350*d* and four exposure devices 380*a* to 380*d*. By means of this structure, full color printing is realized. The reference numeral 360 shows a supply roller. The reference numeral 362 shows a developing roller. The reference numeral 364 shows the photoreceptor drum. The reference numeral 366 shows a transfer roller.

The toner is transferred from the photoreceptor drum 364 to the intermediate transfer belt 348 (primary transfer). The toner transferred onto the intermediate transfer belt 348 is then transferred onto the printing sheet 302 between the printing sheet transfer rollers 334, 336 (secondary transfer). Thus the toner is transferred onto the printing sheet 302.

A belt cleaning device 420 is provided to the right of the belt roller 344. The belt cleaning device 420 removes residual toner that has been transferred during the primary transfer onto the intermediate transfer belt 348 but not transferred during the secondary transfer. Further, the printing sheet 302 contacts the intermediate transfer belt 348 between the printing sheet transfer rollers 334, 336, and hence paper particles also may become adhered to the intermediate transfer belt 348. The belt cleaning device 420 also removes paper particles that have become adhered to the intermediate transfer belt 348.

The belt cleaning device 420 comprises a first front roller 432, a second front roller 434, a blade 436, and so on. In this embodiment, the belt roller 344 functions as the back roller of the belt cleaning device 420.

A voltage is applied between the belt roller 344 and the first front roller 432. The first front roller 432 has a lower potential than the belt roller 344. A voltage is also applied between the first front roller 432 and second front roller 434. The second front roller 434 has a lower potential than the first front roller 432.

The voltage between the belt roller 344 and first front roller 432 is subjected to constant current control similarly to the control performed on the voltage between the back roller 130 and first front roller 132 in the first embodiment. Further, the voltage between the first front roller 432 and second front roller 434 is subjected to constant current control similarly to the control performed on the voltage between the first front roller 132 and second front roller 134 in the first embodiment.

In the laser printer 310 of this embodiment, the ability of the first front roller 432 to clean the intermediate transfer belt 348 is high. The ability of the second front roller 434 to clean the first front roller 432 is also high. Hence, the ability of the laser printer 310 of this embodiment to clean the intermediate transfer belt 348 is extremely high.

Seventh Embodiment

Figure 14:
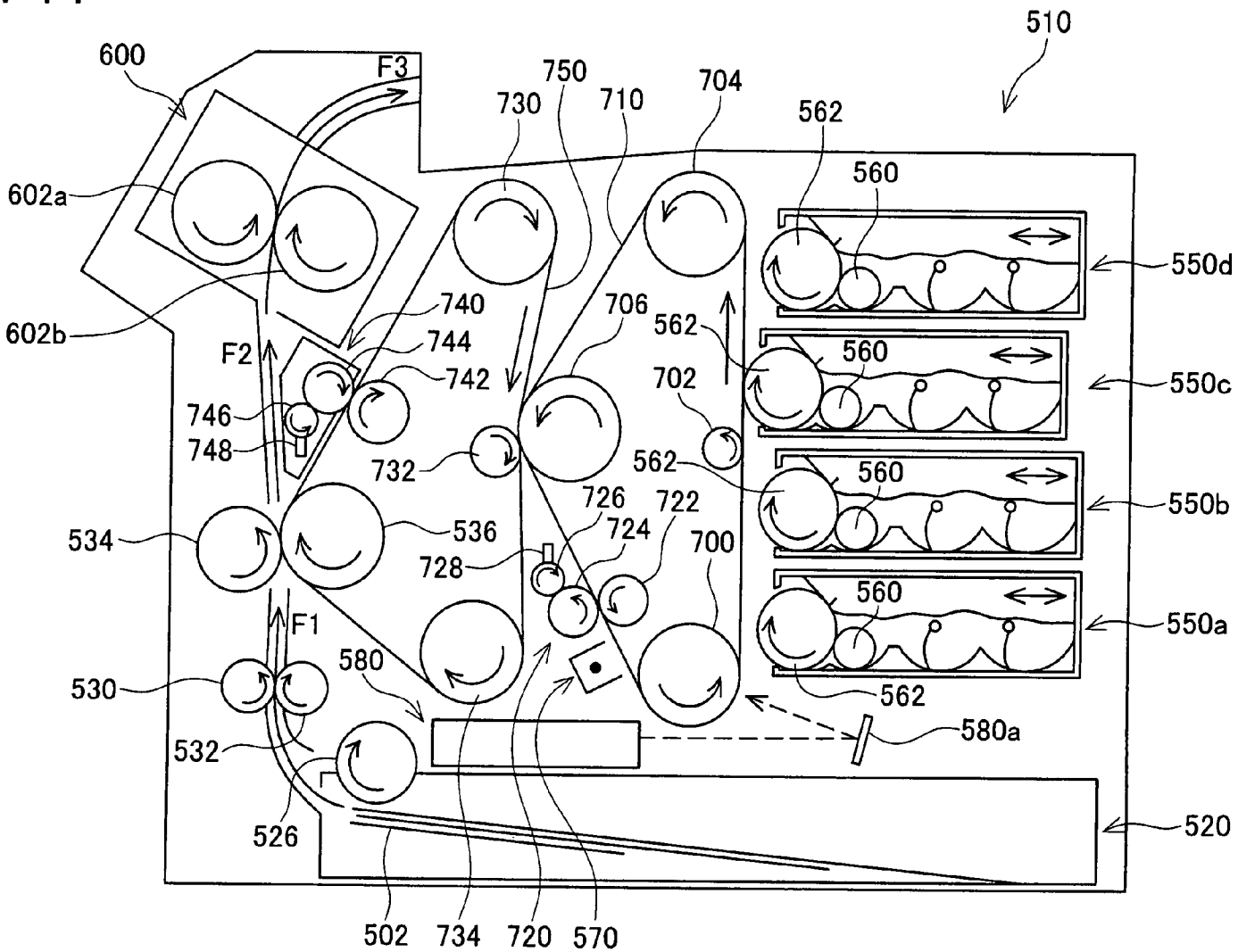
FIG. 14 shows a schematic side view of a laser printer according to a seventh embodiment.

A laser printer 510 of this embodiment will be described with reference to FIG. 14. The laser printer 510 is a secondary transfer type. The laser printer 510 does not adopt a photoreceptor drum. Instead, a photosensitive belt 710 is used. Toner is transferred from the photosensitive belt 710 to an intermediate transfer belt 750 (primary transfer), whereupon the primary-transferred toner is transferred from the intermediate transfer belt 750 to a printing sheet 502 (secondary transfer).

The structure of the laser printer 510 will be described below. Identical names have been used for members that are similar to those of the first embodiment, and detailed description thereof has been omitted. Furthermore, the rotation direction of each roller is indicated in the drawing, and hence detailed description relating to the rotation direction has been omitted.

The laser printer 510 comprises a paper feeding device 520. The printing sheet 502 stored in the paper feeding device 520 is conveyed in the direction of an arrow F1 by a paper feeding roller 526 and conveyance rollers 530, 532.

A pair of secondary transfer rollers 534, 536 is disposed above the conveyance rollers 530, 532. The secondary transfer roller 534 contacts the front surface side of the intermediate transfer belt 750. The secondary transfer roller 534 is connected to a voltage supply circuit not shown in the drawing. When the toner is to be transferred onto the printing sheet 502 from the intermediate transfer belt 750, a transfer bias is applied to the secondary transfer roller 534. The secondary transfer roller 536 contacts the back surface side of the intermediate transfer belt 750. The secondary transfer roller 536 faces the secondary transfer roller 534. Having been conveyed in the direction of the arrow F1, the printing sheet 502 is inserted between the secondary transfer rollers 534, 536. When the secondary transfer rollers 534, 536 are rotated, the printing sheet 502 is conveyed in the direction of an arrow F2.

A toner fixing device 600 is provided above the secondary transfer rollers 534, 536. The toner fixing device 600 comprises a pressure roller 602*a* and a heating roller 602*b*. Having been conveyed in the direction of the arrow F2, the printing sheet 502 is inserted between the pressure roller 602*a* and heating roller 602*b*. The toner transferred onto the printing sheet 502 is fixed on the printing sheet 502 by heat. Having passed through the toner fixing device 600, the printing sheet 502 is conveyed in the direction of an arrow F3 and ejected.

Four development devices 550*a* to 550*d* are disposed in vertical series. Each of the development devices 550*a* to 550*d* comprises a supply roller 560 and a developing roller 562. Each of the development devices 550*a* to 550*d* is structured to be capable of movement in a left-right direction.

The photosensitive belt 710 is disposed on the left side of the development devices 550*a* to 550*d*. Five rollers 700, 702, 704, 706, 722 are disposed on the back surface side of the photosensitive belt 710. When the development devices 550*a* to 550*d* move in a leftward direction, the developing rollers 562 contact the photosensitive belt 710. In FIG. 14, the second development device 550*c* from the top has moved leftward so as to contact the photosensitive belt 710.

A charger 570 is provided below and to the left of the photosensitive belt 710. The charger 570 electrifies the photosensitive belt 710. An exposure device 580 is disposed below the charger 570. A laser beam emitted from the exposure device 580 is reflected by a reflecting mirror 580*a*. The laser beam reflected by the reflecting mirror 580*a* reaches the photosensitive belt 710. As a result, the photosensitive belt 710 is exposed to a pattern corresponding to the print content. The toner carried on the developing roller 562 is developed in the exposed part of the photosensitive belt 710.

A photosensitive belt cleaning device 720 is disposed above the charger 570. The photosensitive belt cleaning device 720 comprises a back roller 722, a first front roller 724, a second front roller 726, a blade 728, and so on. The voltage between the back roller 722 and first front roller 724 is subjected to constant current control similarly to the control performed on the voltage between the back roller 130 and first front roller 132 in the first embodiment. The voltage between the first front roller 724 and second front roller 726 is subjected to constant current control similarly to the control performed on the voltage between the first front roller 132 and second front roller 134 in the first embodiment.

In the laser printer 510 of this embodiment, the ability of the first front roller 724 to clean the photosensitive belt 710 is high. The ability of the second front roller 726 to clean the first front roller 724 is also high. Hence, according to this embodiment, the ability to clean the photosensitive belt 710 is extremely high.

The intermediate transfer belt 750 is disposed on the left side of the photosensitive belt 710. Five rollers 730, 732, 734, 536, 742 are provided on the back surface side of the intermediate transfer belt 750. The roller 732 faces the roller 706. The photosensitive belt 710 and the intermediate transfer belt 750 contact each other between the roller 732 and the roller 706. Thus, the toner developed on the photosensitive belt 710 can be transferred onto the intermediate transfer belt 750 (primary transfer). The toner transferred onto the intermediate transfer belt 750 is then transferred onto the printing sheet 502 between the pair of secondary transfer rollers 534, 536 (secondary transfer).

An intermediate transfer belt cleaning device 740 is disposed on the left side of the intermediate transfer belt 750. The intermediate transfer belt cleaning device 740 comprises a back roller 742, a first front roller 744, a second front roller 746, a blade 748, and so on. The voltage between the back roller 742 and first front roller 744 is subjected to constant current control similarly to the control performed on the voltage between the back roller 130 and first front roller 132 in the first embodiment. The voltage between the first front roller 744 and second front roller 746 is subjected to constant current control similarly to the control performed on the voltage between the first front roller 132 and second front roller 134 in the first embodiment.

In the laser printer 510 of this embodiment, the ability of the first front roller 744 to clean the intermediate transfer belt 750 is high. The ability of the second front roller 746 to clean the first front roller 744 is also high. Hence, the ability of the laser printer 510 according to this embodiment to clean the intermediate transfer belt 750 is extremely high.

Specific examples of the present invention were described in detail above. However, these are merely illustrations, and do not limit the scope of the claims. The technology described in the claims includes various alternatives and modifications of the specific examples described above.

For, example, in the first embodiment, the potential of the back roller 130 (see FIG. 3) is maintained at zero. However, when the potential of the first front roller 132 has been reduced to its limit, the potential of the back roller 130 may be adjusted to a larger value than zero. In so doing, the voltage between the back roller 130 and first front roller 132 can be increased even after the first front roller 132 has reached its minimum potential.

Note that the following image forming device is also useful. This image forming device comprises a photosensitive belt, a back member disposed on the back side of the photosensitive belt, a front member disposed on the front side of the photosensitive belt so as to face the back member, and a device for adjusting a voltage between the back member and front member such that a current flowing between the back member and front member is maintained within a predetermined range.

Further, the technical elements described in the present specification and drawings exhibit technical usefulness either individually or in various combinations, and are not limited to the combinations in the claims at the time of filing. Moreover, the technology illustrated in the present specification and drawings achieves a plurality of objects simultaneously, and possesses technical usefulness simply by achieving one of these objects.

What is claimed is:

1. An image forming device, comprising:

a photoreceptor;

a belt facing the photoreceptor;

a back member disposed on a back side of the belt;

a first front member disposed on a front side of the belt, the first front member disposed adjacent to the belt and facing the back member;

a voltage change device configured to change voltage between the back member and the first front member from a certain value other than zero to another value other than zero; and a sensor configured to detect that a developer cartridge is exchanged, wherein the voltage change device increases the voltage between the back member and the first front member when the sensor detects that the developer cartridge is exchanged.

2. The image forming device as in claim 1, wherein the voltage change device increases the voltage between the back member and the first front member over time.

3. The image forming device as in claim 1, wherein the voltage change device changes the voltage between the back member and the first front member such that current between the back member and the first front member is maintained within a predetermined range.

4. The image forming device as in claim 3, further comprising:

a current sensor that measures the current between the back member and the first front member, wherein the voltage change device changes the voltage between the back member and the first front member based on the current measured by the current sensor.

5. The image forming device as in claim 3, further comprising:

a memory that stores a number of print media and a voltage value corresponding to the number of print media; and a counter that counts a number of print media that have been printed, wherein, in a case where the number counted by the counter is identical to the number of the print media stored in the memory, the voltage change device changes the voltage between the back member and the first front member to the voltage value corresponding to the number of print media.

6. The image forming device as in claim 1, further comprising:

a second front member disposed on the front side of the belt, the second front member disposed adjacent to the first front member; and a device that applies voltage between the first front member and the second front member.

7. The image forming device as in claim 6, wherein the voltage between the first front member and the second front member is constant.

8. The image forming device as in claim 1, wherein at least a surface of the first front member is formed by a foamed material.

9. The image forming device as in claim 1, wherein the belt conveys a print medium, the photoreceptor supports a developer, and the developer supported by the photoreceptor is transferred onto the print medium conveyed by the belt.

10. The image forming device as in claim 1, wherein the photoreceptor supports a developer, the developer supported by the photoreceptor is transferred onto the belt, and the developer on the belt is transferred onto a print medium.

11. The image forming device as in claim 1, wherein the back member is a back roller contacting a back surface of the belt.

12. The image forming device as in claim 11, wherein the belt rotates in a predetermined direction, and the back member rotates in the predetermined direction.

13. The image forming device as in claim 11, wherein the back member is biased toward the first front member.

14. The image forming device as in claim 1, wherein the first front member is a first front roller contacting a front surface of the belt.

15. The image forming device as in claim 14, wherein the belt rotates in a predetermined direction, and the first front member rotates in the predetermined direction.

16. The image forming device as in claim 1, wherein the photoreceptor supports a developer, the developer is positively charged, and the electric potential of the back member is greater than the electric potential of the first front member.

17. An image forming device, comprising:

a photoreceptor;

a belt facing the photoreceptor;

a back member disposed on a back side of the belt;

a first front member disposed on a front side of the belt, the first front member disposed adjacent to the belt and facing the back member;

a second front member disposed on the front side of the belt, the second front member disposed adjacent to the first front member;

a device that applies voltage between the back member and the first front member;

a first voltage change device configured to change voltage between the first front member and the second front member from a certain value other than zero to another value other than zero; and a sensor configured to detect that a developer cartridge is exchange, wherein the first voltage change device changes the voltage between the first front member and the second front member when the sensor detects that the developer cartridge is exchanged.

18. The image forming device as in claim 17, wherein the first voltage change device increases the voltage between the first front member and the second front member over time.

19. The image forming device as in claim 17, wherein the first voltage change device changes the voltage between the first front member and the second front member such that current between the first front member and the second front member is maintained within a predetermined range.

20. The image forming device as in claim 19, further comprising:

a current sensor that measures the current between the first front member and the second front member, wherein the first voltage change device changes the voltage between the first front member and the second front member based on the current measured by the current sensor.

21. The image forming device as in claim 19, further comprising:

a memory that stores a number of print media and a corresponding voltage value; and a counter that counts a number of print media that have been printed, wherein, in a case where the number counted by the counter is identical to the number of the print media stored in the memory, the first voltage change device changes the voltage between the first front member and the second front member to the corresponding voltage.

22. The image forming device as in claim 17, further comprising:

a second voltage change device configured to change the voltage between the back member and the first front member from a certain value other than zero to another value other than zero.

23. The image forming device as in claim 17, wherein at least a surface of the second front member is formed by metal.

24. The image forming device as in claim 17, wherein the first front member is a first front roller contacting a front surface of the belt, the first front member rotates in a predetermined direction, the second front member is a second front roller contacting the first front roller, and the second front member rotates in an opposite direction to the predetermined direction.

25. The image forming device as in claim 17, wherein the photoreceptor supports a developer, the developer is positively charged, and the electric potential of the first front member is greater than the electric potential of the second front member.

26. The image forming device as in claim 17, wherein the first voltage change device increases the voltage between the first front member and the second front member when the sensor detects that the developer cartridge is exchanged.

* * * * *

UNITED STATES PATENT AND TRADEMARK OFFICE

CERTIFICATE OF CORRECTION

PATENT NO. : 7,596,335 B2
APPLICATION NO. : 11/497273
DATED : September 29, 2009
INVENTOR(S) : Tsunemitsu Fukami et al.

It is certified that error appears in the above-identified patent and that said Letters Patent is hereby corrected as shown below:

On the Cover Page, Section 57, Line 12:
Please delete "change" and insert --changes--

In Column 23, Claim 17, Line 61:
Please delete "exchange" and insert --exchanged--

Signed and Sealed this

Twenty-second Day of December, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,596,335 B2
APPLICATION NO. : 11/497273
DATED : September 29, 2009
INVENTOR(S) : Fukami et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 202 days.

Signed and Sealed this

Twenty-eighth Day of September, 2010

David J. Kappos

David J. Kappos
*Director of the United States Patent and Trademark Office*